US012173996B2

(12) United States Patent
Treadway et al.

(10) Patent No.: US 12,173,996 B2
(45) Date of Patent: Dec. 24, 2024

(54) MUNITIONS AND METHODS FOR OPERATING SAME

(71) Applicant: Corvid Technologies LLC, Mooresville, NC (US)

(72) Inventors: Sean Kevin Treadway, Mooresville, NC (US); Michael John Worsham, Mooresville, NC (US); Michael Brian Rauls, Mooresville, NC (US); Erik Charles Wemlinger, Troutman, NC (US)

(73) Assignee: Corvid Technologies LLC, Mooresville, NC (US)

( * ) Notice: Subject to any disclaimer, the term of this patent is extended or adjusted under 35 U.S.C. 154(b) by 0 days.

(21) Appl. No.: 18/174,796

(22) Filed: Feb. 27, 2023

(65) Prior Publication Data

US 2024/0044624 A1 Feb. 8, 2024

Related U.S. Application Data

(60) Provisional application No. 63/314,830, filed on Feb. 28, 2022.

(51) Int. Cl.
*F42B 12/22* (2006.01)
*F42B 12/28* (2006.01)

(52) U.S. Cl.
CPC ..... *F42B 12/28* (2013.01)

(58) Field of Classification Search
CPC ..... F42B 12/22; F42B 12/28; F42B 12/32; F42B 12/60
See application file for complete search history.

(56) References Cited

U.S. PATENT DOCUMENTS

| | | | | | |
|---|---|---|---|---|---|
| 37,661 | A * | 2/1863 | Gerardin | F42B 12/32 | 102/495 |
| 50,535 | A * | 10/1865 | Hiscock | F42B 12/32 | 102/495 |
| 96,595 | A * | 11/1869 | Jobson | F42B 12/32 | 102/495 |
| 911,008 | A * | 1/1909 | Heldt | F42B 12/60 | 102/497 |
| 1,154,437 | A * | 9/1915 | Rimailho | F42B 12/32 | 102/496 |
| 1,197,465 | A * | 9/1916 | Dunwoody | F42B 12/50 | 102/370 |
| 1,325,706 | A * | 12/1919 | Todisco | F42B 12/32 | 102/495 |
| 2,362,414 | A * | 11/1944 | Simpson | F42B 12/60 | 102/393 |
| 2,393,275 | A * | 1/1946 | Whitesell, Jr. | F42B 12/22 | 86/56 |
| 2,401,483 | A * | 6/1946 | Hensel | F42B 12/76 | 86/51 |
| 2,413,008 | A * | 12/1946 | Taglialatela | F42B 12/28 | 102/389 |

(Continued)

FOREIGN PATENT DOCUMENTS

| | | | | |
|---|---|---|---|---|
| EP | 0273994 | * | 7/1987 | F42B 13/18 |

*Primary Examiner* — Derrick R Morgan
(74) *Attorney, Agent, or Firm* — Myers Bigel, P.A.

(57) ABSTRACT

A warhead includes a tubular warhead body including a plurality of serially arranged preferentially fragmenting projectile rings, and warhead high explosive in the warhead body.

27 Claims, 34 Drawing Sheets

(56) References Cited

U.S. PATENT DOCUMENTS 2,798,431 A * 7/1957 Semon ..... F42B 12/28 102/495
3,021,784 A * 2/1962 Meddick ..... E21B 43/117 102/493
3,026,804 A * 3/1962 Adler ..... F42B 12/32 53/437
3,491,694 A * 1/1970 Fountain ..... F42B 12/22 102/493
3,498,224 A * 3/1970 Cordle ..... F42B 12/32 102/496
3,580,175 A * 5/1971 Kenney ..... F42B 12/22 102/496
3,675,577 A 7/1972 Sternberg et al.
3,677,183 A * 7/1972 Talley ..... F42B 12/22 102/495
3,853,059 A 12/1974 Moe
4,057,001 A * 11/1977 Valentine ..... F42B 12/32 156/149
4,106,410 A 8/1978 Borcher et al.
4,106,411 A * 8/1978 Borcher ..... F42B 12/22 102/495
4,515,083 A * 5/1985 Caruso ..... F42B 12/22 102/493
4,516,501 A 5/1985 Held et al.
4,655,139 A 4/1987 Wilhelm
4,658,727 A 4/1987 Wilhelm et al.
4,662,281 A 5/1987 Wilhelm et al.
4,664,035 A * 5/1987 Osofsky ..... F42B 12/22 102/493
4,774,889 A * 10/1988 Wallow ..... F42B 12/06 102/491
5,117,759 A * 6/1992 Henderson ..... F42B 12/32 102/496
5,544,589 A 8/1996 Held
6,174,587 B1 1/2001 Figge
6,962,113 B1 * 11/2005 Carlson ..... F42B 12/22 102/389
7,066,093 B2 6/2006 Ronn et al.
7,347,906 B1 3/2008 Guirguis
7,845,282 B2 12/2010 Sheridan et al.
8,250,986 B1 8/2012 Sheridan et al.
8,276,520 B1 * 10/2012 Fong ..... F42B 12/22 102/493
8,387,539 B1 3/2013 Maines
8,904,936 B2 * 12/2014 Treadway ..... F42B 12/02 102/315
9,062,954 B2 6/2015 Treadway et al.
9,109,865 B2 8/2015 Haskins
9,683,822 B2 6/2017 Kerns et al.
9,784,541 B1 10/2017 Genson et al.
9,829,297 B2 11/2017 Graswald
10,415,939 B2 * 9/2019 Pichler ..... F42B 12/28
10,982,942 B1 * 4/2021 Stowe ..... F42D 5/045
11,614,311 B1 * 3/2023 Bonnstetter ..... F42B 12/56 102/496
2002/0166475 A1 * 11/2002 Brooks ..... F42B 12/60 102/489
2004/0011238 A1 1/2004 Ronn et al.
2005/0087088 A1 * 4/2005 Lacy ..... F42B 12/32 102/495
2009/0078147 A1 * 3/2009 Ronn ..... F42B 12/60 102/494
2010/0282115 A1 11/2010 Sheridan et al.
2012/0227609 A1 9/2012 Volkmann
2013/0042782 A1 2/2013 Haskins
2014/0113086 A1 4/2014 Greenhill et al.
2016/0231096 A1 8/2016 Kerns et al.
2016/0370159 A1 12/2016 Bootes et al.
2016/0377398 A1 * 12/2016 Daebelliehn ..... F42B 12/26 29/428
2017/0115108 A1 4/2017 Kerns et al.
2020/0300591 A1 * 9/2020 Painter, III ..... F42B 12/60

* cited by examiner

MUNITIONS AND METHODS FOR OPERATING SAME

RELATED APPLICATION

The present application claims the benefit of and priority from U.S. Provisional Patent Application No. 63/314,830, filed Feb. 28, 2022, the disclosure of which is incorporated by reference herein in its entirety.

FIELD

The present invention relates to warheads and munitions and, more particularly, to warheads and munitions including projectiles.

BACKGROUND

Munitions such as bombs and missiles are used to inflict damage on targeted personnel and material. Some munitions of this type include a warhead including a plurality of projectiles and high explosive to project the projectiles at high velocity.

SUMMARY

According to some embodiments, a warhead includes a tubular warhead body including a plurality of serially arranged preferentially fragmenting projectile rings, and warhead high explosive in the warhead body.

According to some embodiments, the warhead includes a warhead body liner. The preferentially fragmenting projectile rings are mounted on the warhead body liner.

In some embodiments, the warhead includes an adhesive bonding the preferentially fragmenting projectile rings to the warhead body liner. The preferentially fragmenting projectile rings, the warhead body liner and the adhesive form a unitary composite fragmenting warhead body.

In some embodiments, the warhead of includes an adhesive bonding the preferentially fragmenting projectile rings to one another.

According to some embodiments, the warhead body liner defines a plurality of steps, and the preferentially fragmenting projectile rings are mounted in respective ones of the steps.

According to some embodiments, the warhead includes an outer cover mounted over the preferentially fragmenting projectile rings.

In some embodiments, at least one of the preferentially fragmenting projectile rings includes an integral locator feature configured to rotationally align the preferentially fragmenting projectile ring with the warhead body liner.

In some embodiments, the warhead body liner includes an integral reinforcement rib.

In some embodiments, the referentially fragmenting projectile rings are formed of metal and the warhead body liner is formed of a polymer.

According to some embodiments, at least one of the preferentially fragmenting projectile rings includes an integral mounting feature configured to connect the warhead to a munition platform.

According to some embodiments, the warhead has a warhead longitudinal axis, and at least some of the preferentially fragmenting projectile rings are rotationally asymmetric about the warhead longitudinal axis.

In some embodiments, the warhead further includes at least one non-fragmenting projectile beam.

In some embodiments, the warhead further includes at least one integral mounting hardpoint member.

According to some embodiments, at least one of the preferentially fragmenting projectile rings includes a non-reactive base ring and a reactive material mounted on the base ring.

In some embodiments, the non-reactive base ring defines voids therein, and the reactive material is mounted in the voids.

In some embodiments, the reactive material forms an outer ring component surrounding the non-reactive base ring.

According to some embodiments, the warhead includes an outer warhead subassembly and an axial core subassembly. The outer warhead subassembly defines a core slot. The outer warhead subassembly includes the warhead body and the warhead high explosive. The axial core subassembly is mounted in the core slot. The axial core subassembly includes: an axial core tube formed of a non-explosive material; a forward effector in or on the axial core tube; and an axial core high explosive disposed in the axial core tube and operative, when detonated, to drive the forward effector.

According to some embodiments, a munition includes a munition platform and a warhead on the munition platform for flight therewith. The warhead includes a tubular warhead body including a plurality of serially arranged preferentially fragmenting projectile rings, and a warhead high explosive in the warhead body.

According to some embodiments, a modular warhead includes an outer warhead subassembly and an axial core subassembly. The outer warhead subassembly defines a core slot. The outer warhead subassembly includes a warhead body, and a warhead high explosive operative, when detonated, to drive fragments from the warhead body. The axial core subassembly is mounted in the core slot. The axial core subassembly includes: an axial core tube formed of a non-explosive material; a forward effector in or on the axial core tube; and an axial core high explosive disposed in the axial core tube and operative, when detonated, to drive the forward effector.

According to some embodiments, the warhead high explosive is tubular and radially surrounds the core slot.

In some embodiments, the modular warhead includes an array of fragments or at least one preferentially fragmenting member radially surrounding the warhead high explosive.

In some embodiments, the outer warhead subassembly includes a tubular core slot wall defining the core slot and formed of a non-explosive material.

In some embodiments, the modular warhead includes a detonator configured to detonate the axial core high explosive, wherein the modular warhead is configured such that a detonation shock wave from the detonated axial core high explosive will detonate the warhead high explosive.

According to some embodiments, the modular warhead includes a detonator configured to detonate the warhead high explosive, wherein the modular warhead is configured such that a detonation shock wave from the detonated warhead high explosive detonates the axial core high explosive.

According to some embodiments, the warhead is configured to detonate the axial core high explosive, the detonated axial core high explosive generates a detonation shock wave in the axial core tube to drive the forward effector, and the axial core tube shapes the detonation shock wave.

In some embodiments, the forward effector includes at least one of an explosively formed projectile, an anti-armor flyer, and a shaped charge jet.

According to some embodiments, the modular warhead includes: a detonation channel including a channel tube and a detonation channel explosive in the channel tube; and a detonator configured to detonate the detonation channel explosive. The modular warhead is configured such that a detonation wave from the detonated detonation channel explosive propagates through the channel tube to the axial core high explosive and detonates the axial core high explosive to drive the forward effector.

In some embodiments, the warhead has a warhead longitudinal axis, and the axial core subassembly is not aligned with the warhead longitudinal axis.

In some embodiments, the modular warhead is configured such that the detonation wave from the detonated detonation channel explosive also detonates the warhead high explosive after the detonation wave from the detonated detonation channel explosive detonates the axial core high explosive to drive the forward effector.

According to some embodiments, a munition includes a munition platform and a modular warhead on the munition platform for flight therewith. The modular warhead includes an outer warhead subassembly and an axial core subassembly. The outer warhead subassembly defines a core slot. The outer warhead subassembly includes a warhead body, and a warhead high explosive operative, when detonated, to drive fragments from the warhead body. The axial core subassembly is mounted in the core slot. The axial core subassembly includes: an axial core tube formed of a non-explosive material; a forward effector in or on the axial core tube; and an axial core high explosive disposed in the axial core tube and operative, when detonated, to drive the forward effector.

BRIEF DESCRIPTION OF THE DRAWINGS

The accompanying figures are included to provide a further understanding of the invention(s), and are incorporated in and constitute a part of this specification. The drawings illustrate some embodiments of the technology and, together with the description, serve to explain principles of the present invention(s).

DESCRIPTION

Figure 1:
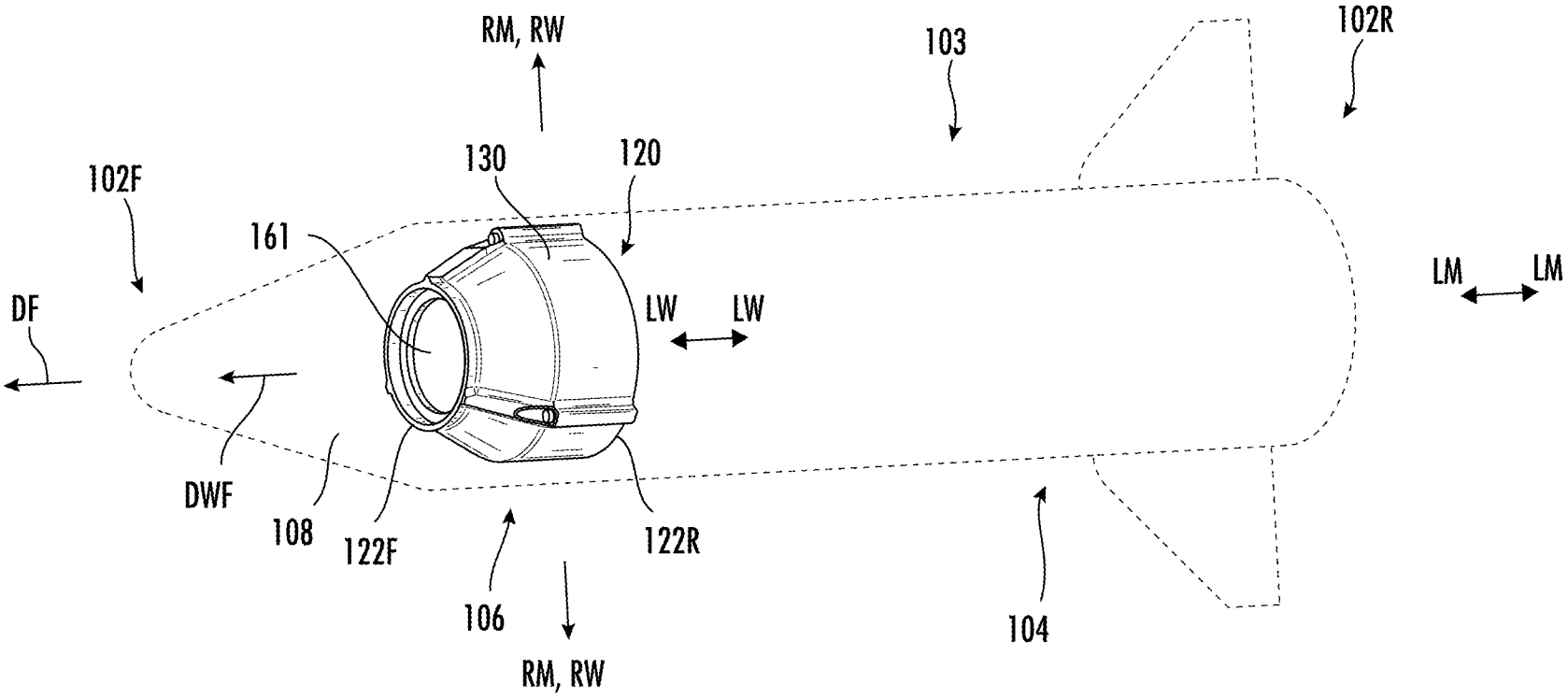
FIG. 1 is a front perspective view of a munition including according to some embodiments.

The present inventions now will be described more fully hereinafter with reference to the accompanying drawings, in which illustrative embodiments of the inventions are shown. In the drawings, the relative sizes of regions or features may be exaggerated for clarity. These inventions may, however, be embodied in many different forms and should not be construed as limited to the embodiments set forth herein; rather, these embodiments are provided so that this disclosure will be thorough and complete, and will fully convey the scope of the inventions to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "monolithic" means an object that is a single, unitary piece formed or composed of a material without joints or seams.

The term "automatically" means that the operation is substantially, and may be entirely, carried out without human or manual input, and can be programmatically directed or carried out.

The term "programmatically" refers to operations directed and/or primarily carried out electronically by computer program modules, code and/or instructions.

The term "electronically" includes both wireless and wired connections between components.

In "deflagration" of an explosive material, decomposition of the explosive material is propagated by a flame front which moves relatively slowly through the explosive material at speeds less than the speed of sound within the explosive material substance (usually below 1000 m/s). This is in contrast to "detonation", occurs at speeds greater than the speed of sound.

Aspects of inventive technology disclosed herein are directed to warhead designs that can provide for modularity in that components and subassemblies of the warhead can be varied to provide a range of lethal effects to address specific targets, engagement conditions, and particular arrangements and/or orientations within a munition, missile, or other delivery method (referred to generally as a munition herein). In some aspects and embodiments, the warhead is a preferentially fragmenting ring composite warhead that is scalable in size and modular. In some aspects and embodiments, the warhead includes an axial core subassembly that includes a core high explosive (HE), an axial core tube and a forward effector. The forward effector may include an explosively formed projectile (EFP), or an anti-armor flyer, or a shaped charge jet (SCJ), or fragments, for example. The warhead may include high explosive (HE) fill that is pour-cast and/or press formed military grade plastic bonded explosives (PBX). Warheads according to some inventive embodiments may be referred to herein as an Extensible Warhead (EW).

The overall modular, scalable EW design or architecture can enable a rapidly adaptable, tunable composite warhead body with a provision for anti-armor effects that keeps the performance of the fragmenting body and the performance of anti-armor component largely independent from one another. The composite construction method enables multi-role fragment effects, structural and flight load carrying capability, and rapid adaptation to different delivery vehicle mounting methods.

In some embodiments, the axial core subassembly uses or provides explosive detonation wave shaping (by the introduction of an impedance mismatch as discussed herein) that enables the integration of a variety of explosively formed projectiles and allows the production of coherent, intact, projectiles in otherwise prohibitive overall munition form factors. The introduction of a tubular structure (i.e., the axial core tube) within the composite warhead body minimizes the effects of non-ideal warhead case geometries on the shape of the driving shock wave to form EFP's, SCJ's, or heavy flyer plates. The axial core subassembly can be integrated with the warhead body at initial munition manufacture or assembly or in the field. The axial core subassembly may even be interchangeable with another axial core subassembly in the field.

The preferentially fragmenting ring and ring body design can include a metal component and polymer component composite structure that enables a number of novel design elements, such as multiple fragment types (perforator fragments and reactive fragments), variable fragment sizes, adaptable mounting methods, and conformal construction in or adjacent complex payload bays.

Aspects of the technology also include manufacturing methods for the fabrication of the composite fragmenting warhead body.

The departure from a largely monolithic fragmenting warhead body to a composite one enables scalability (both size and quantity), the use of low-cost manufacturing methods, more effective fragmentation, rapid adaptation to new target sets and delivery vehicles, and unique new effects.

The composite warhead body can be a stressed member with a variety of mounting options.

The modularity also allows the warhead to be adapted for specific storage, transport, and service environments, with more rugged components being used for more demanding environments. Specific environmental factors of consequence include munition launch and flight loads.

Warheads according to some embodiments of the inventive technologies may include all the aforedescribed aspects, or fewer than all these aspects, as well as other aspects disclosed herein.

The inventive warhead design may be particularly well-suited for multiple roles and effects, e.g., anti-personnel and anti-armor. The inventive warhead design may be a lower-cost alternative to purpose-built warheads with ad hoc modifications to add capability and roles.

Figure 2:
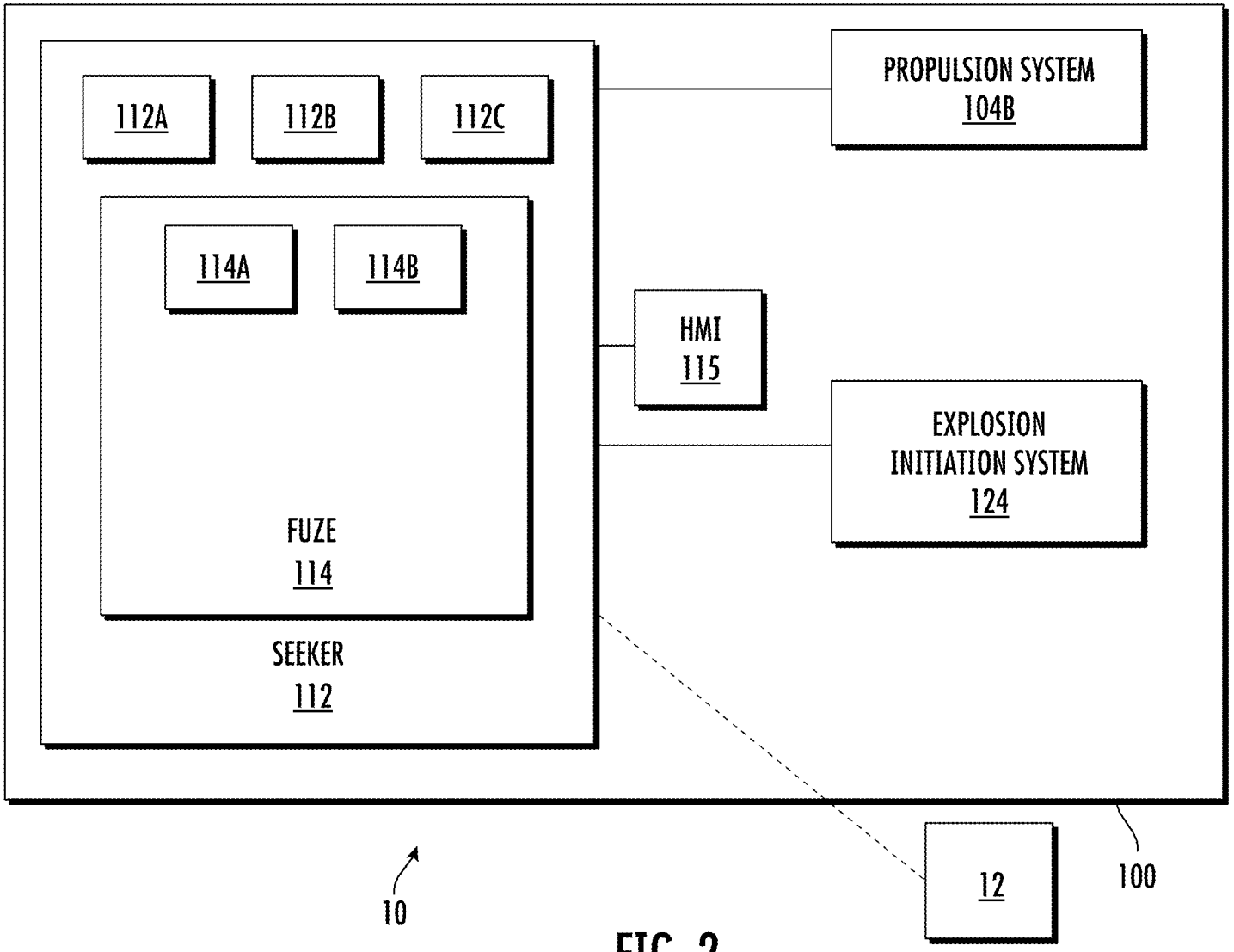
FIG. 2 is a schematic diagram representing a munition system including the munition of FIG. 1.

With reference to FIGS. 1-10, a munition system 10 according to embodiments of the technology is shown therein. The system 10 includes a munition 100 and, optionally, a remote controller 12 (FIG. 2). The munition includes a warhead 120 according to embodiments of the technology. The system 10 may be used to apply a lethal or destructive force to a target or targets E1, E2 (FIGS. 34 and 35) using high energy projectiles 154P and/or a forward effect projection 161P of the munition 100.

The illustrated munition 100 is a missile. However, embodiments of the invention may be used in other types of munitions, such as bombs (e.g., smart bombs). In some embodiments, the munition 100 is a precision guided munition. In use, the munition 100 travels generally in a direction of flight DF.

In some embodiments, the munition system 10 is an Air Launched Effects (ALE) system. ALE systems are munitions adapted from existing Group 2 Unmanned Aerial System (UAS) Intelligence, Reconnaissance, Surveillance (ISR) platforms, which are typically powered by electric motors. In some embodiments, the munition 100 is used in more conventional weapons systems, e.g., AGM-114 Hellfire.

In the illustrated embodiment, the munition 100 includes a munition or missile platform 103 (shown in dashed lines in FIG. 1) and a warhead 120 according to some embodiments of the technology.

With reference to FIG. 1, the munition 100 has a front end 102F and a rear end 102R. The munition 100 has a longitudinal or primary axis LM-LM. The munition 100 also has radial axes (two such radial axes RM-RM are indicated in FIG. 1) that extend perpendicular to the longitudinal axis LM-LM. The munition 100 is configured to travel or fly in the forward direction DF along the longitudinal axis LM-LM. The munition 100 includes a front section 106 adjacent the front end 102F, and a rear section 104 adjacent the rear end 102R.

The rear section 104 serves as the propulsion section. A propulsion system 104B is housed in the rear section 104. The rear section 104 may further include wings or other guidance components.

The front section 106 serves as the operational warhead section. The front section 106 includes a nose section 108 and the warhead 120. In the depicted embodiment, the warhead 120 is disposed directly behind the nose section 108, but other configurations are possible.

A seeker subsystem 112 (FIG. 2) is housed within the nose section 108. The seeker subsystem 112 may include a guidance controller 112A, a communications transceiver 112B, a targeting detection device or system 112C, and/or a fuze 114. The fuze 114 may include an operational controller 114A, and a high voltage (HV) supply 114B.

The targeting system 112C may include a height of burst (HOB) sensor configured to determine an altitude of the munition 100 above the ground, which measurement may serve as an approximation of the instantaneous distance from the munition 100 to the target. However, other targeting detection sensors, devices or systems may be used in place of or in addition to the HOB sensor.

The operational controller 114A may be any suitable device or processor, such as a microprocessor-based computing device. While the operational controller 114A is described herein as being a part of the fuze 114, any suitable architectures or constructions may be used.

The munition 100 or the warhead 120 may be provided with an input device or human-machine interface (HMI) 115. The HMI 115 and/or the remote controller 12 may be used by an operator to provide inputs (e.g., settings, other commands) to the controller 112A and/or to report a status of the warhead 120.

The warhead 120 has a front or leading end 122F and a rear or trailing end 122R spaced apart along its longitudinal axis LW-LW (which in the illustrated embodiment extends substantially parallel or coaxial with the munition primary axis LM-LM). The warhead 120 also has radial axes (two such radial axes RW-RW are indicated in FIG. 1) that extend perpendicular to the longitudinal axis LW-LW. The longitudinal axis LW-LW extends in a warhead forward direction DWF in the direction from the trailing end 122R to the leading end 122F.

The warhead 120 includes a warhead subassembly 130 and an axial core subassembly 160. The warhead 120 includes an explosion initiation system 124 (FIG. 2), a main effector system 125, and a forward effector system 127.

The explosive initiation system 124 includes a detonator 124A (e.g., a booster pellet). The explosion initiation system 124 may further include a trigger (e.g., a timer, switch or accelerometer).

The main effector system 125 includes a main charge 126 of high explosive and a plurality of preferentially fragmenting projectile rings 150 (which form a part of the warhead subassembly 130). The preferentially fragmenting projectile rings 150 are also referred to herein as "fragmenting rings" or "rings".

The forward effector system 127 includes a core charge 128 and a forward effector 161 (which forms a part of the axial core subassembly 160).

The warhead subassembly 130 includes the main charge 126, an external case 132, a base plate 134, fasteners 134A, and a composite fragmenting warhead body 141 (also referred to herein as the warhead body 141). The warhead body 141 includes a warhead body liner 140, an array, stack or set 151 of projectile assemblies 150, and a structural adhesive 159.

The warhead body liner 140 (FIGS. 4-8) includes a tubular outer wall 143 and a tubular slot sleeve or slot wall 148. The outer wall 143 has an outer surface 143A. The illustrated outer wall 143 has a tapered cone leading section 144A and a cylindrical trailing section 144B. An axially distributed series of annular recesses or steps 146 are defined in the outer surface 143A.

The outer wall 143 and the slot wall 148 define an axially extending, annular or tubular main cavity 136 therebetween. An axially extending, cylindrical axial core cavity or slot 138 is defined by and within the slot wall 148. The warhead body 141 defines a forward opening 138A on the leading end 122F that opens into the slot wall 148.

The warhead body liner 140 may be formed of any suitable material(s). In some embodiments, the warhead body liner 140 is formed of an inert material (i.e., a non-explosive, non-reactive material). In some embodiments, the warhead body liner 140 is formed of a polymeric material. In some embodiments, the warhead body liner 140 is formed of a polymeric material selected from the group consisting of Nylon-11, Nylon-12, Glass-filled Nylon-12, Carbon-Filled Nylon-12, or Aluminum-Filled Nylon-12.

The main charge 126 is tubular and annular in cross-section. The main charge 126 partially or completely fills the tubular main cavity 136 and circumferentially surrounds the axial core slot 138.

The set 151 includes a plurality of preferentially fragmenting projectile rings 150. Each ring 150 is a discrete component from the other projectile rings and from the warhead body liner 140. The rings 150 are seated on and surround the outer wall 143 of the liner 140. The adhesive 159 (FIGS. 5 and 7) is interposed between the rings 150 and the liner 140 and bonds the rings 150 to the outer surface 143. In this way, the preferentially fragmenting projectile rings 150, the warhead body liner 140 and the structural adhesive 159 collectively form a warhead body in the form of a composite fragmenting warhead body 141. The composite fragmenting warhead body 141 is a unitary structure.

The rings 150 are serially arranged along the warhead axis LW-LW. That is, the rings 150 are stacked end to end along the warhead axis. In the embodiment of FIGS. 1-10, some of the rings 150 are mounted in respective ones of the steps 146 and some of the rings 150 are mounted on and around the base section 144B.

The structural adhesive 159 is interposed between the inner diameter surface 152C of each ring and the outer surface 143A to directly bond the surfaces 143A, 152C. In some embodiments, the adhesive 159 is interposed between adjacent rings 150 and bonds the rings 150 directly to one another (e.g., bonds the adjacent axial end surfaces 152A, 152B of adjacent rings 150 to one another).

The structural adhesive 159 may be any suitable type of adhesive. In some embodiments, the adhesive 159 is an epoxy. In some embodiments, the adhesive 159 is room temperature vulcanizing (RTV) silicone.

The inner diameter D1 (FIG. 9) of each ring 150 is matched to the outer diameter D2 (FIG. 5) of the outer wall 143 at the mounting location of that ring 150 such that a small gap is present between the ring 150 and the outer wall 143 to receive and contain the adhesive 159. In some embodiments, the inner diameter D1 of each ring 150 is less than 0.045 inch greater than the outer diameter D2 of the outer wall 143 at the mounting location of the ring 150. In some embodiments, the inner diameter D1 of each ring 150 is in the range of from about inch to 0.100 inch greater than the outer diameter D2 of the outer wall 143 at the mounting location of the ring 150.

The shapes and sizes of the preferentially fragmenting projectile rings 150 may be varied so that the that the profile of the array 151 of rings 150 substantially matches the outer profile of the outer wall 143.

Figure 9:
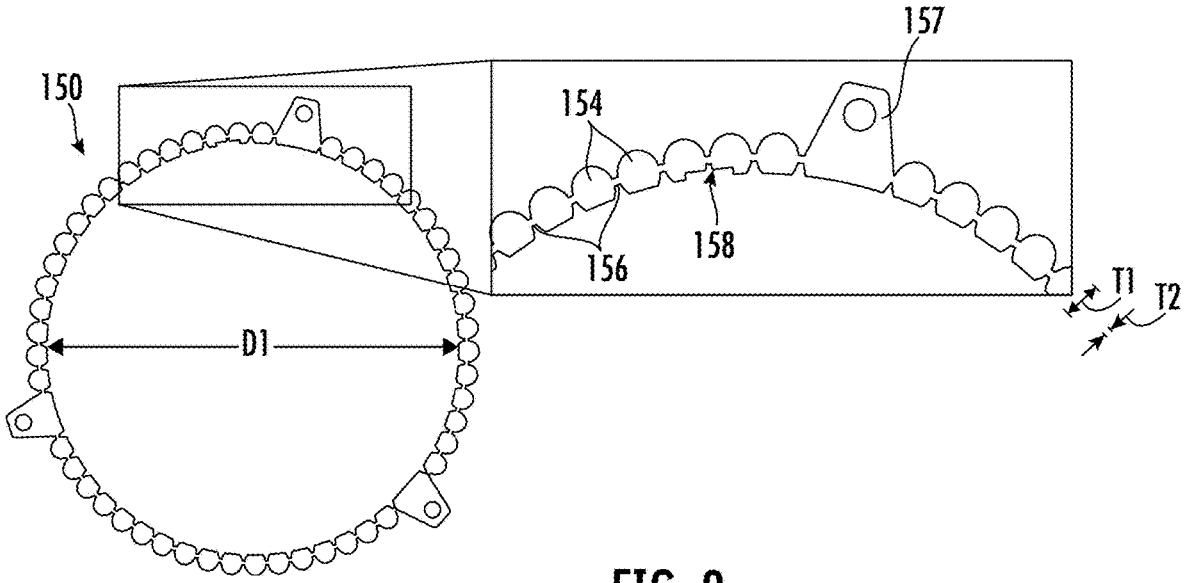
FIG. 9 is front view of a preferentially fragmenting ring forming a part of the warhead of FIG. 1.
Figure 10:
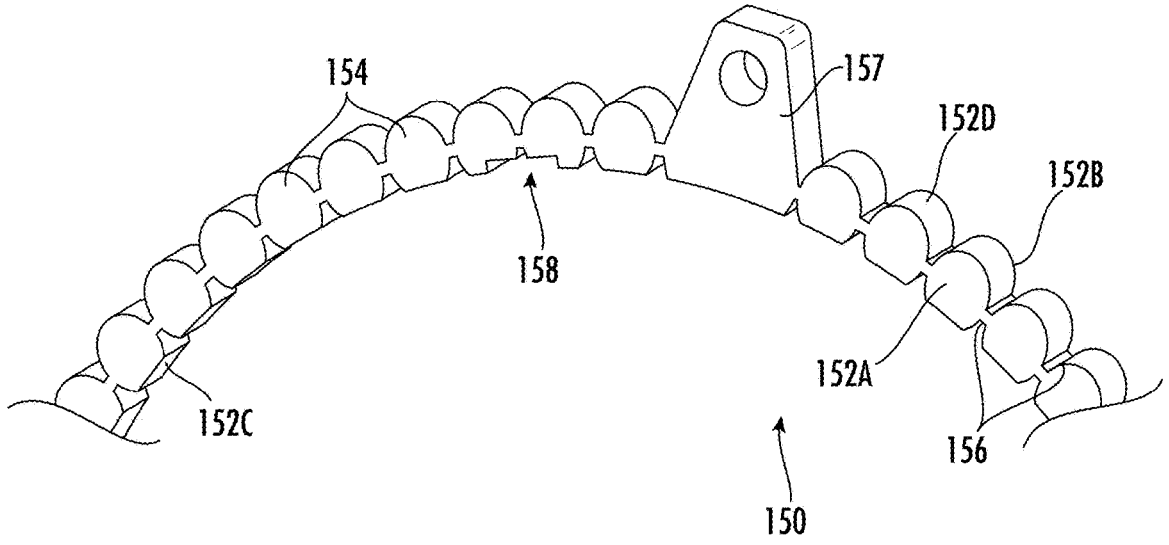
FIG. 10 is a fragmentary, perspective view of the preferentially fragmenting ring of FIG. 9.

An example one of the preferentially fragmenting projectile rings 150 is shown in FIGS. 9 and 10. It will be appreciated that each of the rings 150 may be constructed in the same manner. The ring 150 is annular and has opposed axial end faces 152A, 152B, and annular inner surface 152C (defining the inner profile of the ring 150), and an outer surface 152D (defining the outer profile of the ring 150). In some embodiments, the axial end faces 152A, 152B are substantially planar.

The ring 150 includes a series of fragment sections 154 each joined to its adjacent fragment sections 154 by ligament or connecting sections 156. Each ring 150 may be a single continuous component having repeating pattern of relatively thick prismatic shapes (fragments 154) joined by ligaments or connecting sections (connecting sections 156).

The connecting sections 156 form relatively weak regions as compared to the fragment sections 154. As a result, the ring 150 will break at the connecting sections 156 when subjected to explosive force from the annular main charge 126, thereby enabling the fragment sections 154 to become projectiles independent of one another.

In some embodiments (e.g., as illustrated in FIG. 9), the preferentially fragmenting projectile ring 150 forms a continuous, endless band. In some embodiments, the ring 150 is monolithic and forms a continuous, endless band.

In some embodiments, each ring 150 includes at least 57 fragment sections 154. In some embodiments, each ring 150 includes from about 10 to 500 fragment sections 154.

In some embodiments, the fragment sections 154 each have an axial width W1 (FIG. 7) in the range of from about 0.05 inch to 0.5 inch.

In some embodiments, the fragment sections 154 each have a radial thickness T1 (FIG. 9) in the range of from about 0.1 inch to 1.0 inch.

In some embodiments, the connecting sections 156 each have a radial thickness T2 (FIG. 9) in the range of from about 0.01 inch to 0.10 inch. In some embodiments, the radial thickness T2 is less than about 10 percent of the thickness T1 of the fragment sections 154.

In some embodiments, the warhead body 141 includes at least 10 preferentially fragmenting projectile rings 150.

In some embodiments, the inner diameter of each ring 150 is at least 5 times the ring's axial width W1.

In some embodiments, at least some of the preferentially fragmenting projectile rings 150 are configured such that the ring includes only a single row (i.e., extending transverse to the warhead axis LW-LW) of fragment sections 154. In some embodiments, each of the preferentially fragmenting projectile rings 150 are configured such that the ring includes only a single row of fragment sections 154.

In some embodiments, the ring 150 is pattern-cut (e.g., water-jet, laser) from metal sheet stock.

Additional features can be included in the ring sections 154. For example, in some embodiments one or more of the rings 150 include an integral structural attachment point feature or mounting lug 157 (FIGS. 9 and 10) that protrudes radially beyond other fragments 154 for warhead assembly. The attachment feature 157 may include a relatively tall fragment with a tab that can engage into an external shell for alignment purposes, or have additional drilled, machined, or flat cut features for mounting to an external frame or delivery platform.

In some embodiments one or more of the rings 150 includes an integral assembly key or alignment feature such as an interior groove 158 (FIGS. 9 and 10). The alignment feature is used to positively locate the ring 150 relative to the warhead body liner 140 so that the ring 150 is rotationally aligned with the warhead body liner 140. In some embodiments, the alignment feature of the ring 150 mates with a cooperating feature on the warhead body liner 140.

The preferentially fragmenting projectile ring 150 may be formed of any suitable material(s). In some embodiments, the ring 150 is formed of an inert material (i.e., a nonreactive, non-explosive material). In some embodiments, the ring 150 is formed of metal. In some embodiments, the ring 150 is formed of a metal selected from the group consisting of steel, nickel, tungsten, titanium, or magnesium alloys.

Alternative materials and further features and alternatives for the preferentially fragmenting projectile rings 150 are discussed below.

Figure 3:
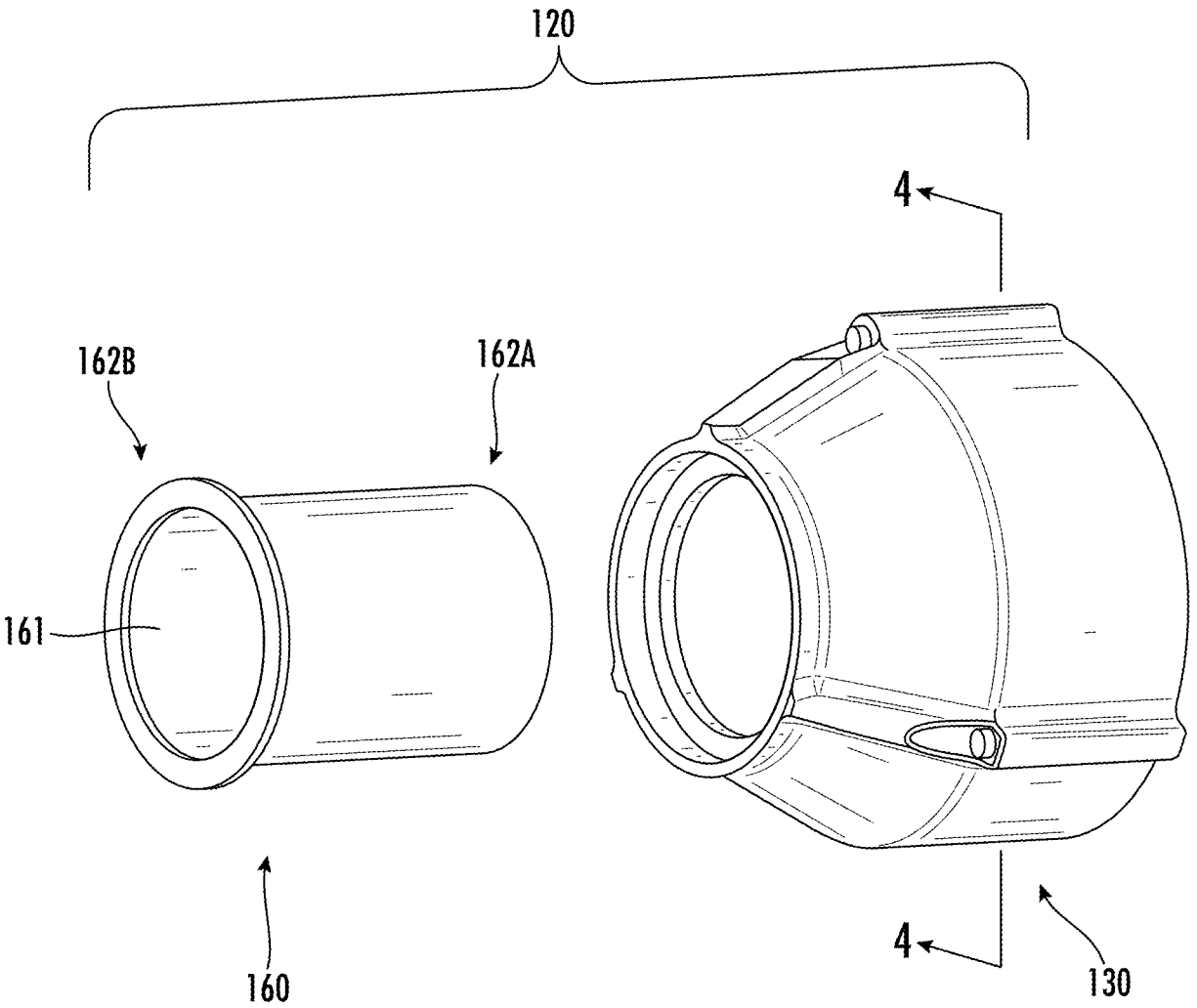
FIG. 3 is an exploded, front perspective view of the warhead of FIG. 1.
Figure 4:
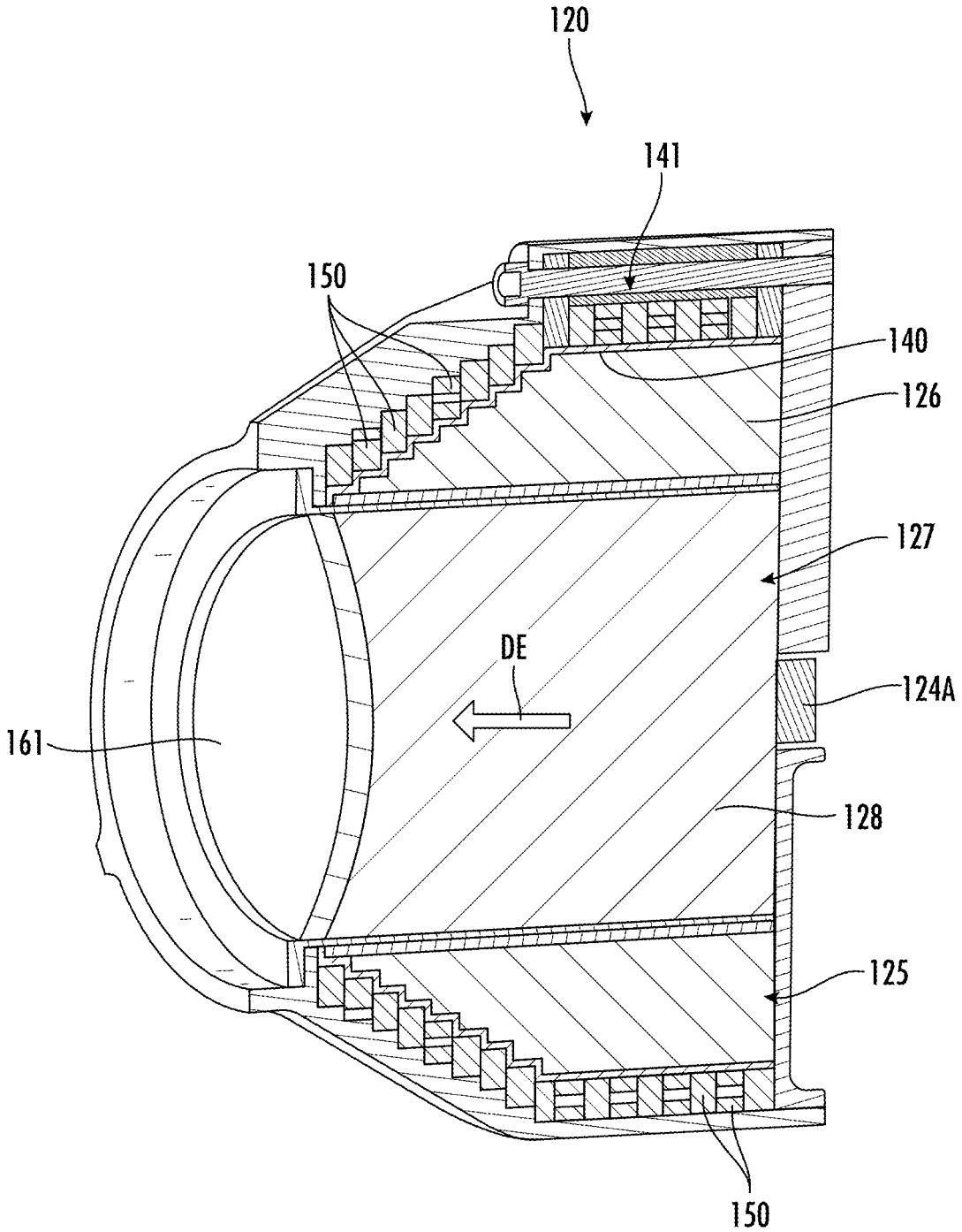
FIG. 4 is a cross-sectional view of the warhead of FIG. 1 taken along the line 4-4 of FIG. 3.
Figure 5:
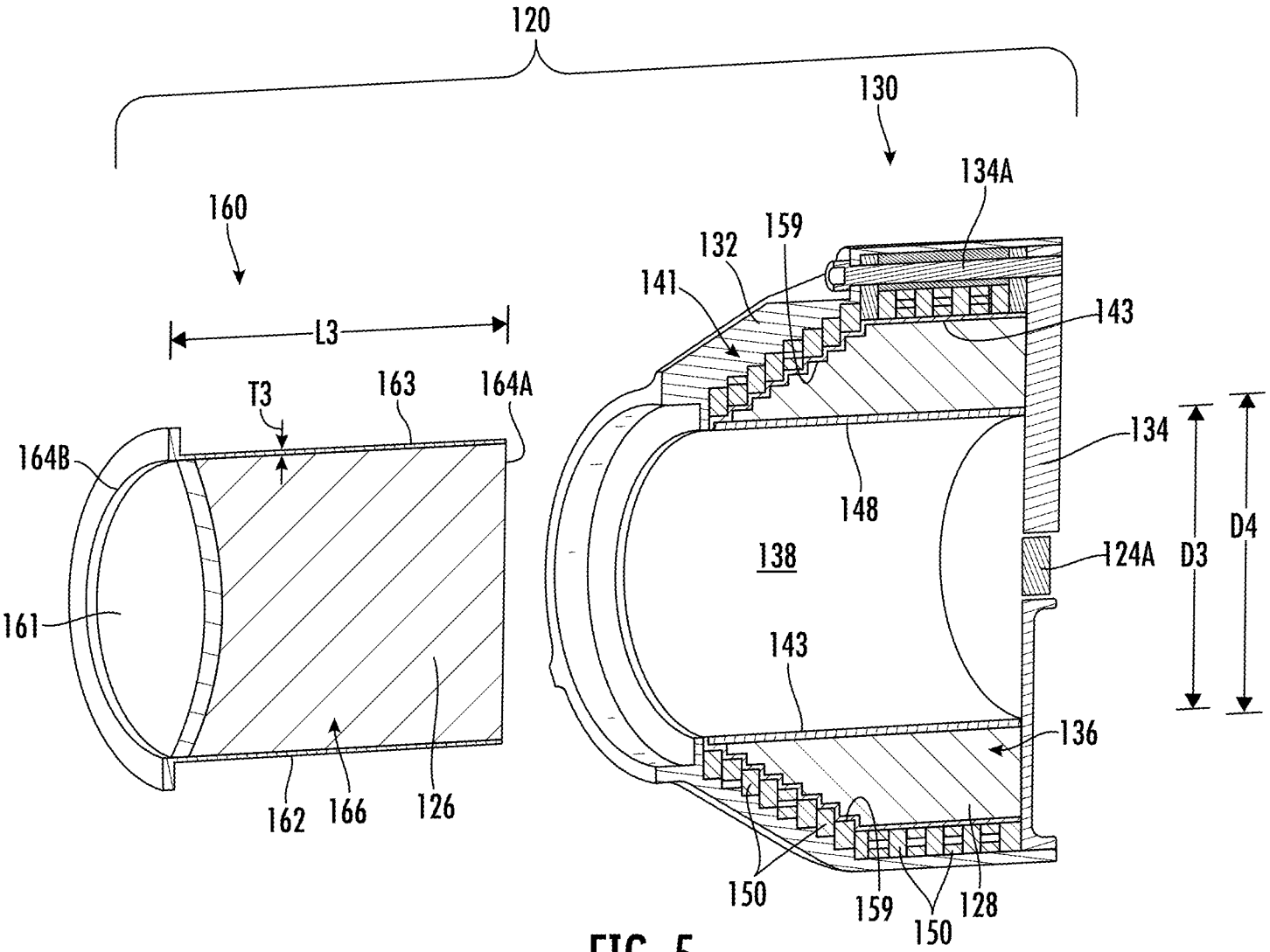
FIG. 5 is an exploded cross-sectional view of the warhead of FIG. 1 taken along the line 4-4 of FIG. 3.
Figure 6:
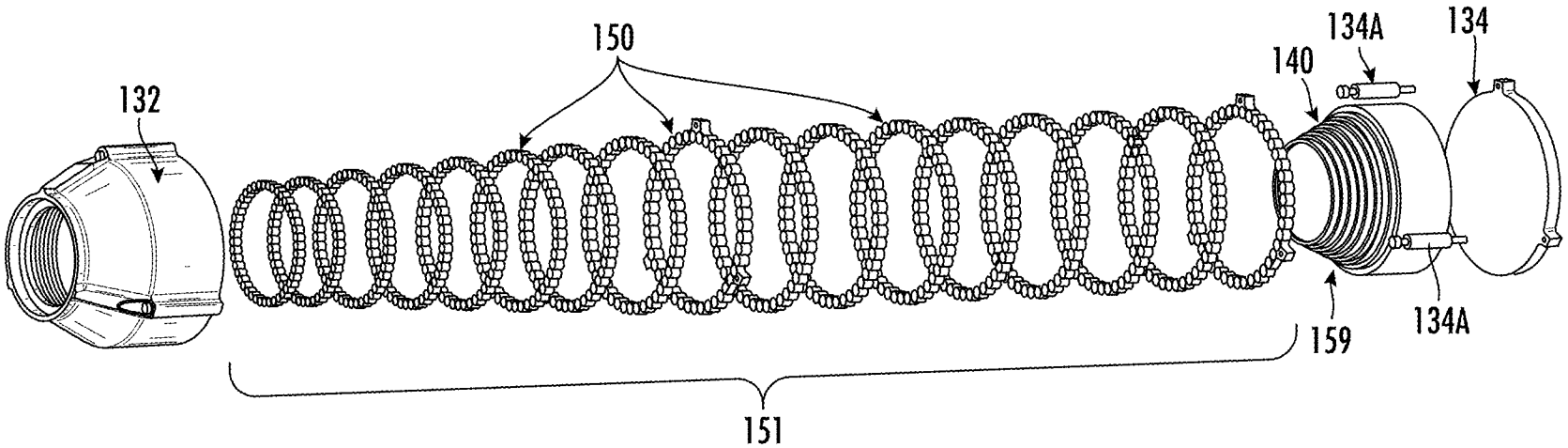
FIG. 6 is an exploded, perspective view of the warhead of FIG. 1
Figure 7:
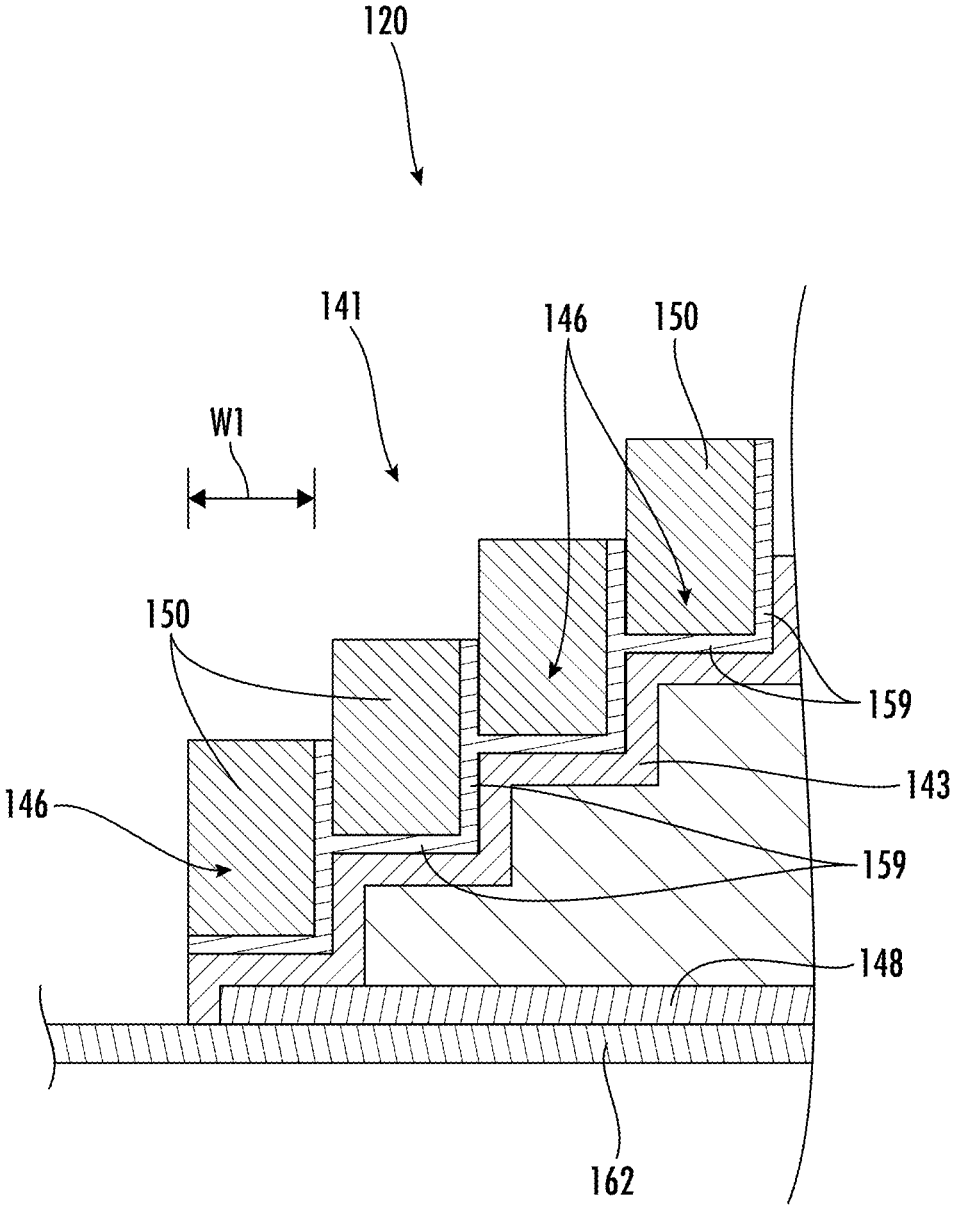
FIG. 7 is an enlarged, fragmentary, cross-sectional view of the warhead of FIG. 1 taken along the line 4-4 of FIG. 3.
Figure 8:
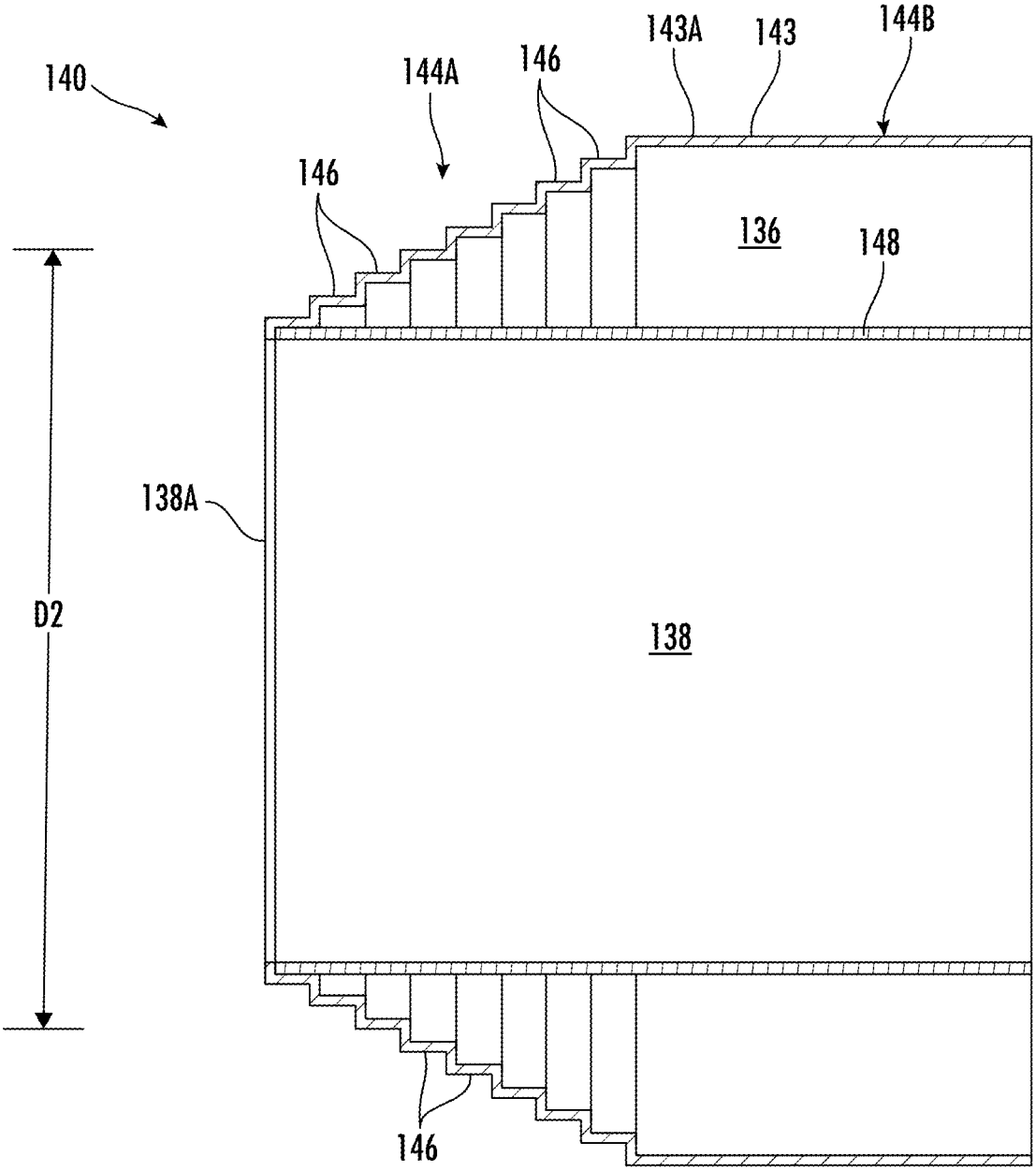
FIG. 8 is a cross-sectional view of a body liner forming a part of the warhead of FIG. 1 taken along the line 4-4 of FIG. 3.

With reference to FIGS. 3-5, the axial core subassembly 160 includes an inner sleeve or axial core tube 162, a core charge 128 of high explosive, and a forward effector 161.

The axial core tube 162 is tubular and extends axially from a rear end 162A to a forward end 162B. The axial core tube 162 defines an axially extending core cavity 166 the terminates at end openings 164A and 164B.

The axial core tube 162 is formed of a non-reactive, non-explosive material (i.e., an inert material). In some embodiments, the axial core tube 162 is formed of a polymeric material. In some embodiments, the axial core tube 162 is formed of a polymeric material selected from the group consisting of Nylon-11, Nylon-12, Glass-filled Nylon-12, Carbon-Filled Nylon-12, or Aluminum-Filled Nylon-12. In some embodiments, the axial core tube 162 is formed of or includes carbon material.

The wall of the axial core tube 162 has a thickness T3 (FIG. 5) and an axial length L3 (FIG. 5). In some embodiments, the thickness T3 is in the range of from about 0.020 inch to 0.200 inch. In some embodiments, the length L3 is in the range of from about 2 inches to 20 inches.

The forward effector 161 is mounted in or on the forward opening 164B and may extend into the core cavity 166. The core charge 128 fills some or all of the core cavity 166. In some embodiments, the core charge 128 is a cylindrical column.

The illustrated forward effector 161 is an EFP insert. However, as discussed herein other types and configurations of forward effectors (e.g., an SCJ insert or fragment pack) may be used that provides desired weapon effect or as target requirements dictate.

Any suitable high explosive may be used for the annular main charge 126. Suitable HE explosives for the main charge 126 may include PBXN-110, PBXN-112, PBXN-109, or PBXN-9.

Any suitable high explosive may be used for the core charge 128. Suitable HE explosives for the core charge 128 may include PBXN-110, PBXN-112, PBXN-109, or PBXN-9. In some embodiments, the axial core high explosive fill 128 is pour-cast and/or press formed military grade plastic bonded explosives (PBX).

In some embodiments, the HE explosive of the core charge 128 is different than the HE explosive of the main charge 126. The explosive fill compositions 126, 128 can be individually selected to improve performance of each component separately and, as discussed herein, compatibility is enforced by the inert tubular construction of the axial core tube 162 and wave shaping techniques.

The axial core subassembly 160 is inserted into the core slot 138 and retained therein such that the axial core subassembly 160 and the warhead body 141 form a unit. The axially extending slot 138 defined by the slot wall 148 of the warhead body liner 140 is configured to receive the axial core tube 162 such that the outer surface 163 of the axial core tube 162 is in close proximity (and, in some embodiments intimate contact) with the inner surface 143 of the slot wall 148. The slot wall 148 of the warhead body 141 has an inner diameter D4 (FIG. 5) that is slightly (e.g. 0.010 inch to 0.025 inch) greater than the outer diameter D3 (FIG. 5) of the portion of the axial core tube 162 seated in the core slot 138. In some embodiments, the inner diameter D4 is not more than 0.050 inch greater than the outer diameter D3. In some embodiments, the inner diameter D4 is in the range of from about 0.010 inch to 0.025 inch greater than the outer diameter D3.

Various methods may be used to retain the axial core subassembly 160 in the core slot 138. Such methods may include mating threaded collars at the forward ends of the core tube 162 and the slot wall 148, screws that come through the warhead back plate 134 and thread into inserts in the aft end of the axial core subassembly 160, and retention by the warhead outer cover 132.

The axial core subassembly 160 may be installed either at initial assembly of the warhead 120 before delivery to the end user, or by the end user in the field as appropriate. The axial core assembly 160 may be interchanged with another axial core assembly in the slot 138.

The munition system 10 and the munition 100 may be used as follows in accordance with some embodiments.

Initially, the munition 100 is suitably prepared or armed. This may be executed in known manner, for example.

The munition 100 is launched and transits toward the target. The munition 100 may fly to the vicinity of the target under the power of the propulsion system 104B. The flight of the munition 100 may be navigated using the guidance system 112A, the targeting detection system 112D, and/or commands from the remote controller 12 received via the communications transceiver 112B. According to some embodiments, the munition 100 will thereafter execute the steps described below automatically and programmatically.

Once the munition 100 reaches the vicinity of the target, the munition 100 is triggered to fire. In some embodiments, the warhead 120 is triggered to fire by the HOB sensor 112C.

In some embodiments, the target is detected by the target detection system 112D and the trigger sequence is initiated by a signal to the fuze 114 from the target detection system 112D. The fuze 114 may take one or more of the terminal conditions of the munition 100 (e.g., height above target, velocity, or angle of approach) as inputs, and from this determine when to initiate actuation of the detonator 124A. In some embodiments, the trigger sequence in initiated automatically and programmatically and each of the steps from trigger sequence initiation to firing are executed automatically without additional human input.

Responsive to being triggered as described above, the fuze 114 causes the explosion initiation system 124 to actuate the detonator 124A. In some embodiments the fuze 118 sends a firing initiation signal to the explosion initiation system 124 in the form of a high current (from the high voltage supply 114B) sufficient to heat a hot wire on the detonator 124A to detonate the detonator 124A (e.g., a booster pellet). However, other techniques for triggering initiation of the detonator 124A may be used.

Upon actuation, the explosion of the detonator 124A detonates the core HE explosive charge 128 at the aft end 162A of the tubular axial core tube 162.

The detonation wave front of the ignited core charge 128 travels or propagates within the passage 166 of the core tube 162 in a direction DE (FIG. 4) from the aft end 162A to the front end 162B. The detonation wave front of the ignited core charge 128 drives the forward effector 161 to project forward with high energy.

The detonation wave front of the ignited core charge 128 also detonates the annular main charge 126. The detonation wave front of the ignited main charge 126 generates gas pressure and shock waves that break the warhead body 141 (including breaking the fragment sections 154 of the rings 150 at the connecting sections 156) and drive or project the projectiles 154 outward with high energy. The projection profile of the projectiles 154 will depend on the configuration of the warhead body 141 and the main charge 126.

The inert axial core tube 162 produces detonation and pressure wave shaping within the core charge 128. The inert axial core tube 162 separates the axial core charge 128 from the annular main charge 126 that is the primary driver for the outer preferentially fragmenting projectile rings 150. The material and thickness of the axial core tube 162 are selected so that the desired wave shaping occur while still transmitting a shock sufficient to produce detonation in the main charge 126. This allows for a single point of initiation at the aft end of the core charge 128 that will subsequently cause detonation of all warhead HE. Thus, the function of axial core subassembly 160, and the weapon effects of this subassembly, are isolated from the external warhead body 141 and its weapon effects. This isolation allows for the scaling or changing the main charge 126 and outer preferentially fragmenting projectile rings 150 without disrupting the axial core weapon effects (i.e., the forward effector effect).

The warhead 120 thereby provides a dual projection effect that can provide corresponding dual damage effects. The actuated forward effector system 127 provides a forward effect and the actuated main effector system 125 provides a main effect. In the illustrated embodiment of the warhead 120, the main effect will tend to be projection of projectiles 154P radially outward and forward.

The axial core subassembly 160 is a unique modular component of the warhead 120. The axial core subassembly 160 can be configured in multiple ways as dictated by the unique fitment and weapon target sets. The axial core subassembly 160 includes the forward effector section 161, the non-explosive (inert) tubular body 162, and the explosive material fill 128. The explosive fill 128 does not need to match the explosive fill 126 of the outer section annular section 136. In addition to the providing for the interchangeability of forward projectile sections 161 in an efficient manner, the axial core inert tube body 162 also creates an internal boundary condition on the axial core explosive fill 128 detonation front that serves to isolate it from the remainder of the outer warhead explosive fill 126 and warhead body 141. This ensures that the modularity of the warhead body 141 is not limited by forward effector selection.

The mechanism that creates the internal boundary condition of the axial core subassembly 160 is the impedance mismatch of the inert tube 162, relative to the unreacted outer explosive 126, and the inert tube 162 material's arrest of the axial core explosive fill 128 detonation. This impedance mismatch results in a suitable axial core shock wave being able to drive, in a semi-isolated manner, the forward effector section 161. Axial core forward effectors can include a shaped charge jet (SCJ), explosively formed projectile (EFP) (e.g., as shown in FIG. 4), pre-formed fragments, or any other nose section configuration that can be formed and/or launched by a shaped detonation shock wave.

The geometry of the forward effector material can be varied to produce different terminal effects and robustness to obstructions early in flight. A small radius of curvature or conical profile will produce a SCJ while a larger radius of curvature will result in an EFP. The effector material can be any ductile material. In some embodiments, the effector material includes copper.

Figure 11:
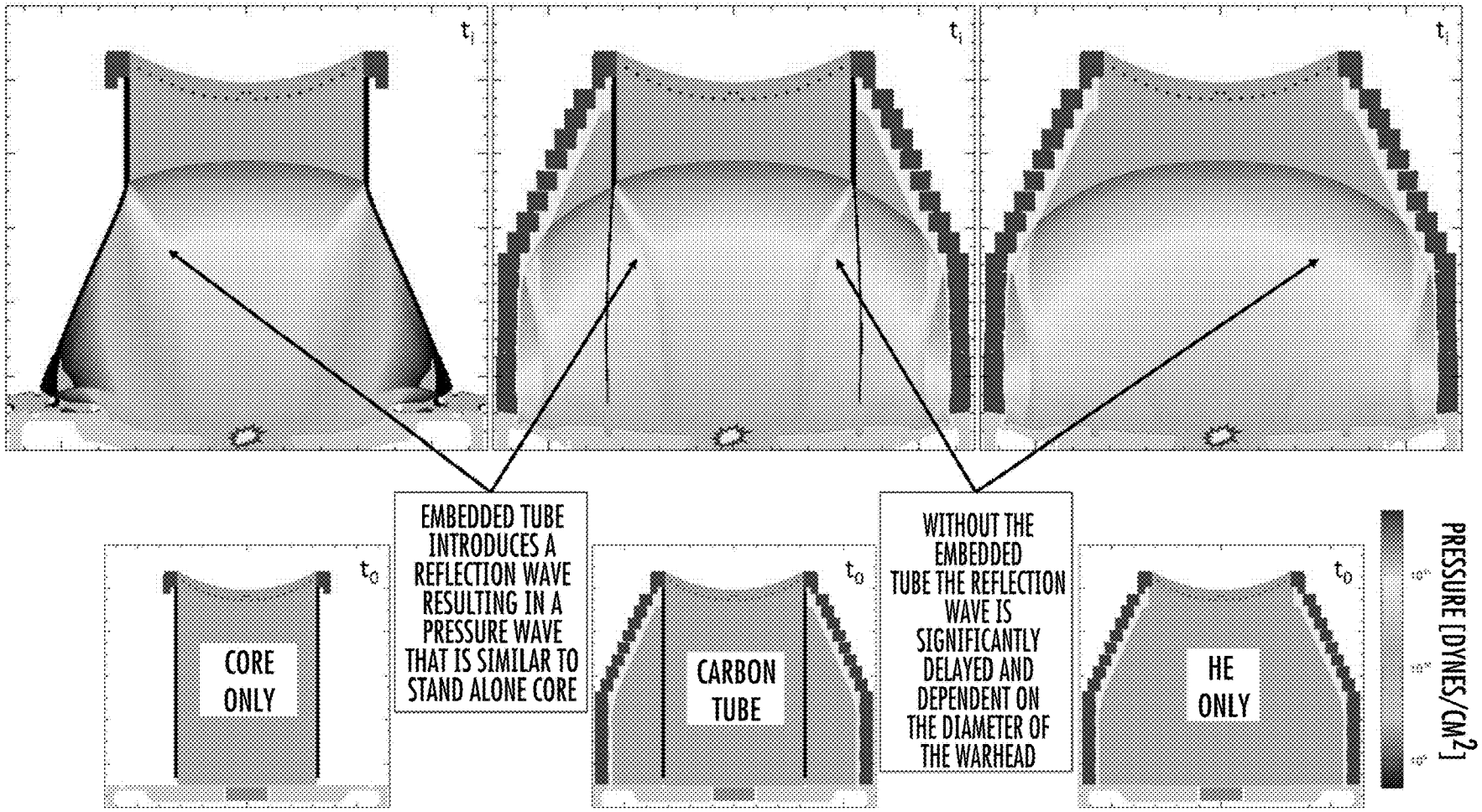
FIG. 11 is a schematic diagram illustrating pressure wave shaping performance of the warhead of FIG. 1.

The performance of the axial core subassembly 160 needs to account for being installed into an arbitrarily shaped warhead body 141 as well as its energetic fill 128. FIG. 11 illustrates the how the inert tube 162, in this case formed from carbon, creates a pressure wave profile that is shaped by the reflection shown in the core only case (also shown in FIG. 11).

Figure 12:
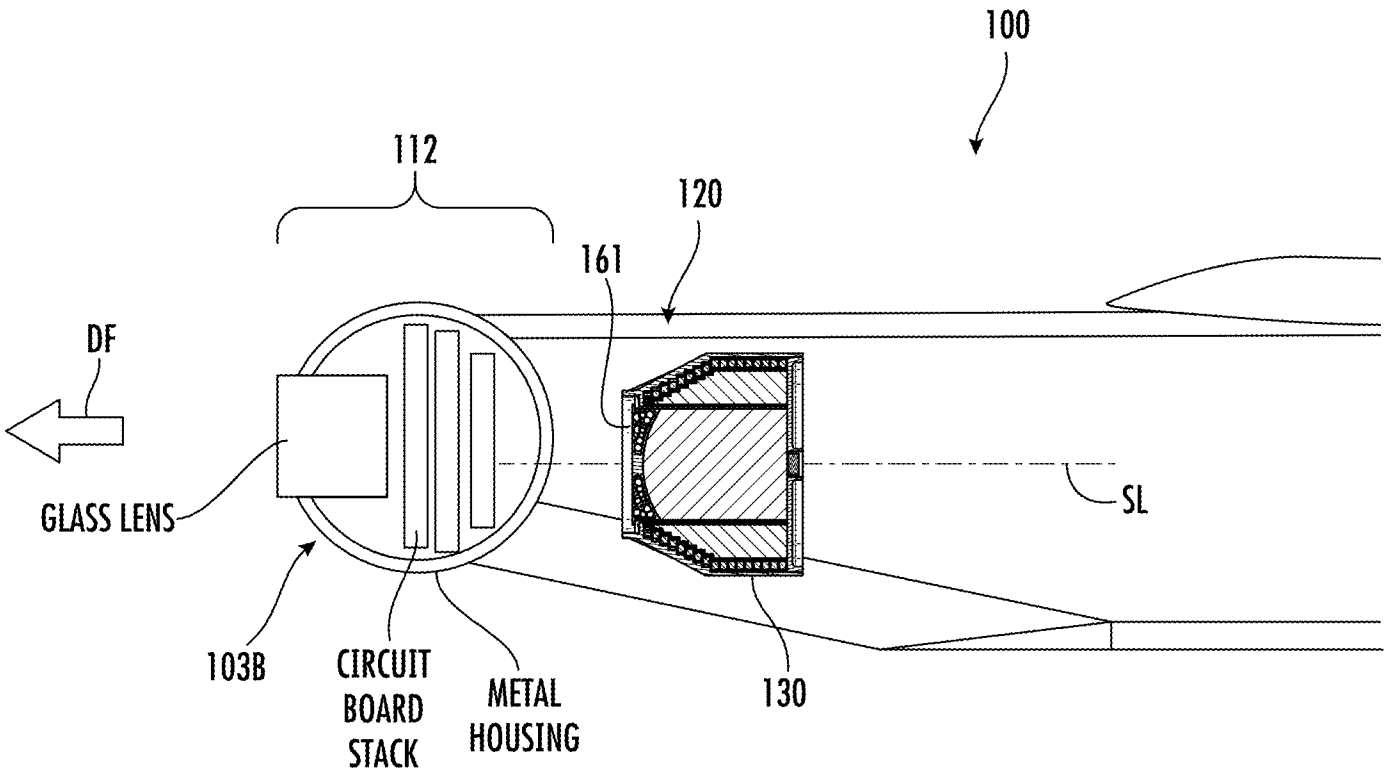
FIG. 12 is a schematic view of an installation including the warhead of FIG. 1.

Successful formation of an EFP or SCJ is very sensitive to the shape of the impinging pressure wave. Release waves from the warhead body boundary and overly flat driving waves can lead to premature breakup of the forward effector or incomplete formation. A shock impedance (computed as material density multiplied by the shock wave speed) mismatch between the energetic material (i.e., the HE charge 128) and the tubular body (i.e., the axial core tube 162) of the axial core assembly 160 is used to induce shock wave reflections and modify the wavefront shape. The key result of this mismatch is that the shock wave in the outer energetic zone lags the shock wave in the axial core HE 128 of the axial core subassembly 160. The EFP can be tuned for specific applications to accommodate installation requirements in various delivery vehicles as well as terminal effectiveness. FIG. 12 shows an example installation including an Extensible Warhead 120 mounted in a delivery vehicle 103, wherein the axial core tube 162 thereof is a carbon tube and the forward effector 161 is an EFP that has been tuned to be a bit thicker than a standard EFP to allow the EFP to penetrate delivery vehicle components 103B and remain effective at the target. A representative shot line SL is shown in FIG. 12.

The modularity of the design allows for multiple EFP designs that can be tuned for target or the platform environment.

Figure 13:
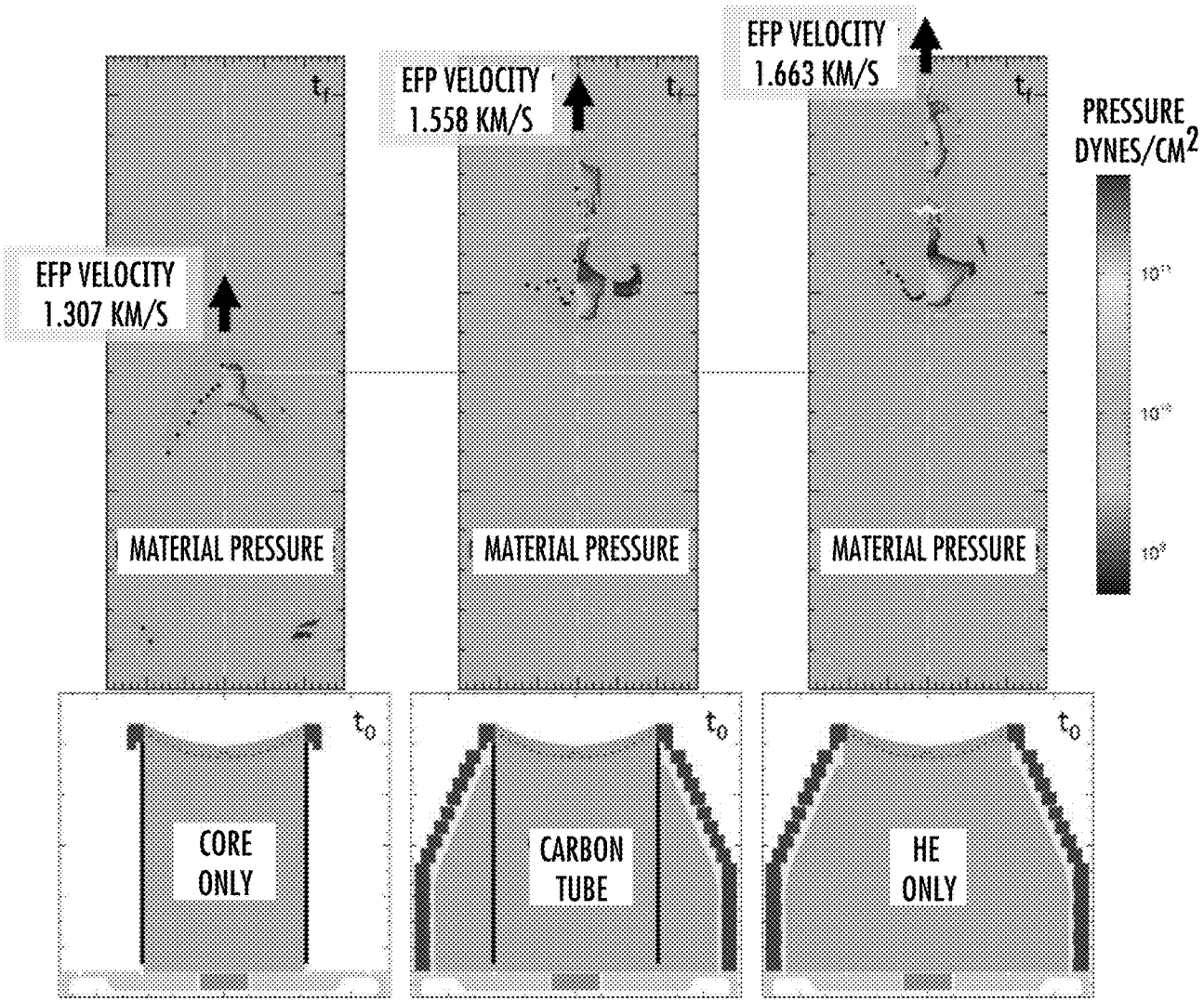
FIG. 13 is a schematic diagram illustrating EFP shaping performance of the warhead of FIG. 1.

The thickness and radius of curvature of both the leading and trailing faces of the EFP liner 161 can be adjusted to achieve various levels of early time robustness of the forward effector projectile and terminal performance. The degree of wave front shaping can be varied by choice of the energetic fill material 128 as well as the tube 162 material. FIG. 13 demonstrates the necessity of shaping the stress wave profile. The resulting EFP shapes for axial core subassembly only, full Extensible Warhead assembly, and no axial core tube in an Extensible Warhead assembly are shown.

Figure 14:
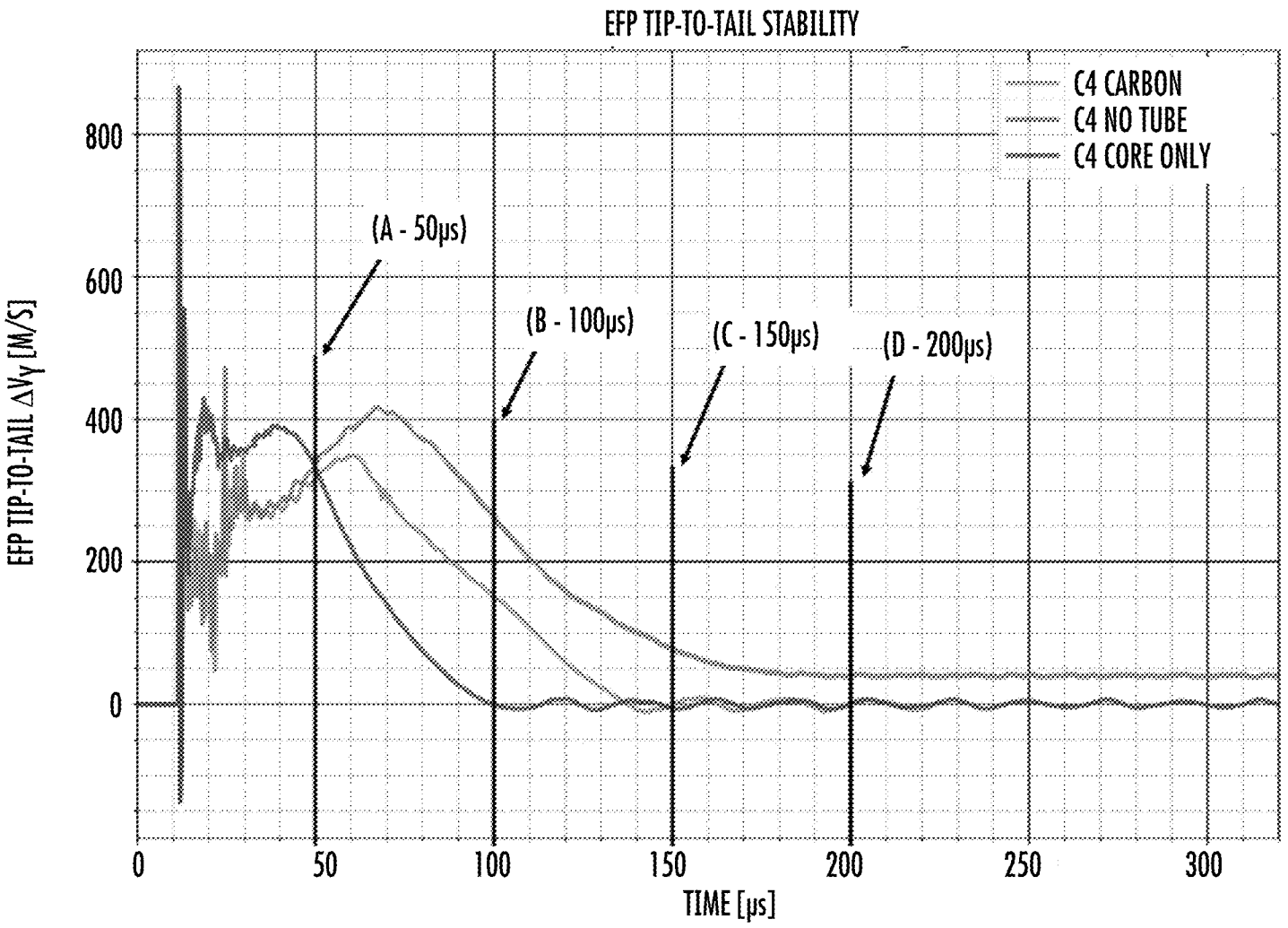
FIG. 14 is a graph illustrating EFP shape development by the warhead of FIG. 1, representing the velocity difference between the tip section and the tail section of the EFP over time.

Although the shape of the EFP between the full Extensible Warhead assembly 120 and the Extensible Warhead assembly without the axial core tube 162 appears to be similar, there is a fundamental difference. The EFP shape is stable with the inclusion of the axial core tube 162, where it is not stable when the axial core tube 162 is omitted. An EFP is considered to be stable when its shape does not continue to change as it travels. FIG. 14 plots the difference between the nose and tail sections of the EFP over time.

Figure 15:
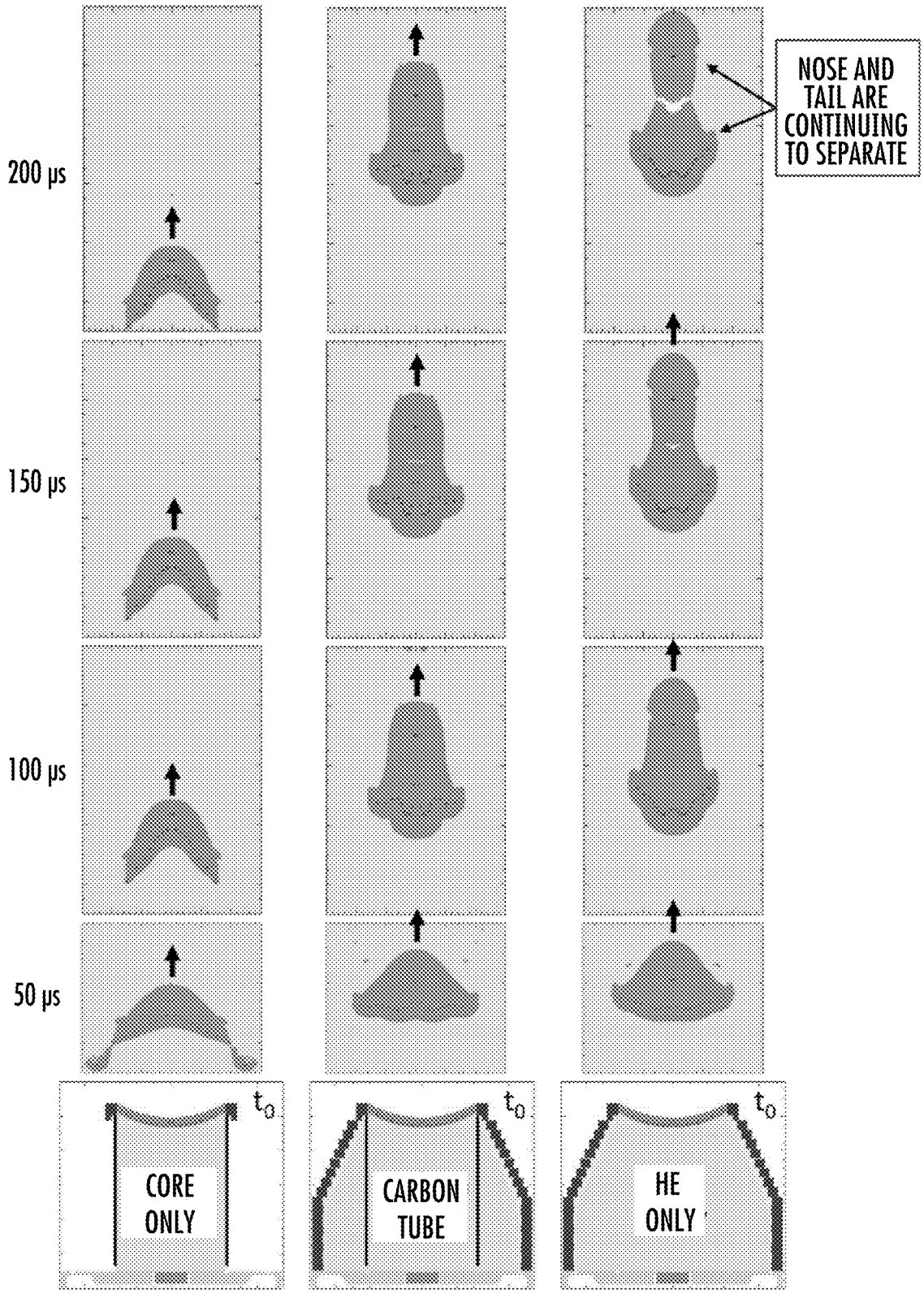
FIG. 15 is a schematic diagram illustrating EFP development by the warhead of FIG. 1 as a function of time after shock wave impingement.

The shape of the EFP 161 continues to evolve when there is no tubular section present. In both cases where the axial core tube 162 is present (by itself and installed in a full Extensible Warhead assembly 120) the EFP stabilizes by 150 μs after the impingement of the shock wave. Lack of stability in an EFP as shown in FIG. 15 typically indicates breakup of the EFP in flight, resulting in poor terminal performance. FIG. 15 illustrates this with four snapshots in time after the impingement of the shock wave. While the material composing the EFP is severely deformed, the shape remains static after 150 μs of flight. When the tubular section is omitted, the forward and aft segments of the EFP separate and the gap continues to grow at the rate shown in FIG. 15. Thus, the inclusion of a shock wave tuning structure in the axial core assembly 160 enables the development of a successful EFP in an arbitrarily shaped warhead body 141, separating the development of the axial core assembly 160 and the warhead subassembly 130 and guaranteeing true modularity.

The implementation of the axial core tube 162 and its associated wave reflecting effects vastly change the shape of the EFP, most notably its thickness in the direction of travel. This specific EFP geometry (as defined by the initial thickness, radius of curvature of the forward and rear faces, and impinging shock wave shape) was designed to improve stability and terminal performance when the effector must first pass through a stack of delivery vehicle avionic and guidance components. Note that for when the energetic material is C4 the resulting EFP velocity is 1.5 km/s while if PBXN-5 is used the resulting EFP velocity increases to 1.8 km/s.

Figure 16:
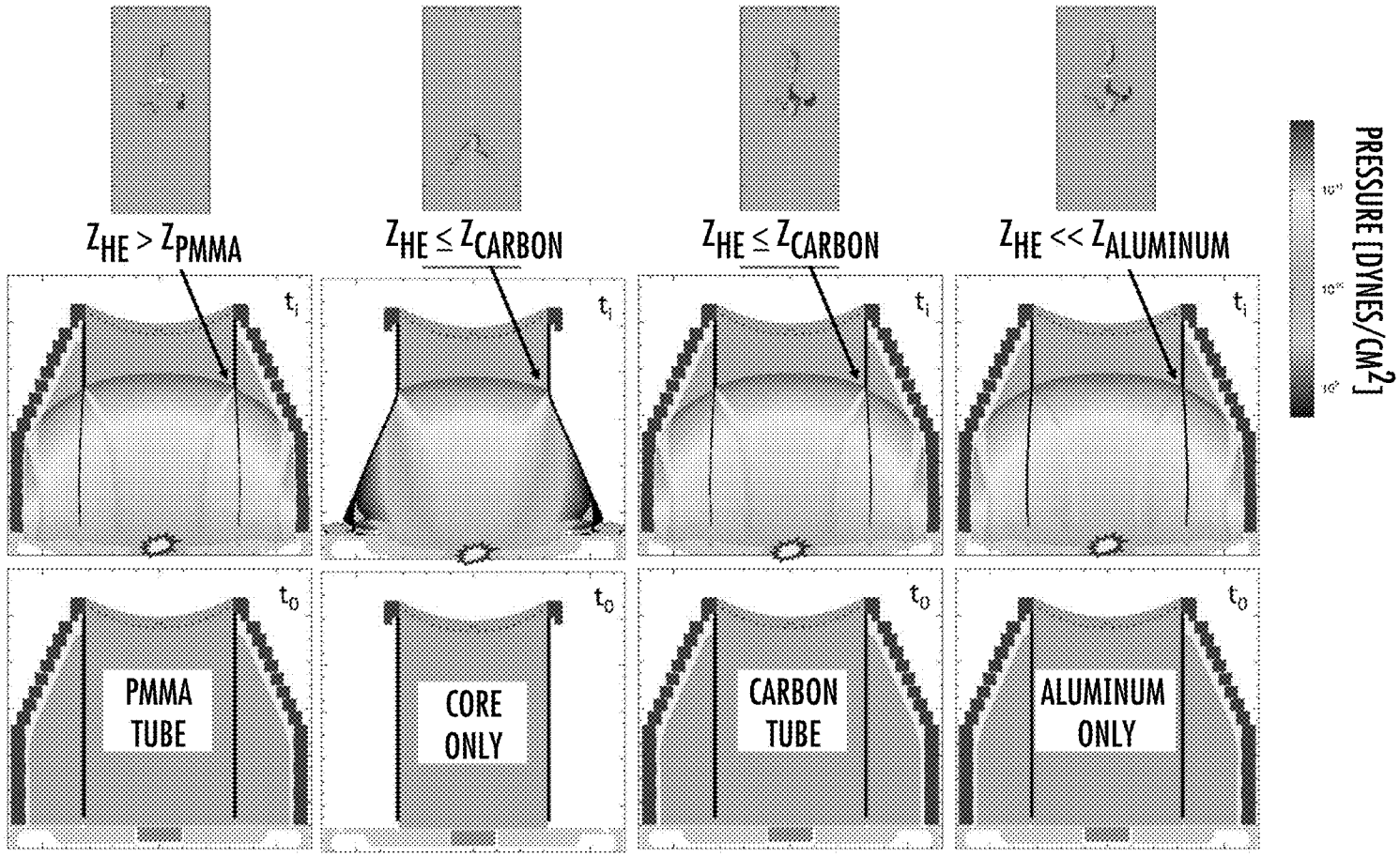
FIG. 16 is a schematic diagram illustrating the dependence of EFP shape development on axial core tube material in the warhead of FIG. 1.

FIG. 16 shows how changing the axial core tube 162 material alters the reflected shock wave and the resulting EFP shape. The EFP shape does not vary greatly given the different materials. The stability does vary a minor bit with the PMMA and aluminum showing a bit more separation than the carbon tube case. Once the material is chosen then the liner can be tuned for performance.

The axial core subassembly 160 can be adjusted to alter the forward effector's characteristics into a SCJ, an EFP or any number of other configurations such as pre-formed fragments, to incendiaries. The mass to charge ratio of the full warhead assembly 120 does not change appreciably, resulting in minimal performance changes to fragmentation and fragment velocity of the composite fragmenting warhead body 141. The simplified geometry also allows for duplex explosive charges within the warhead assembly 120, when each explosive volume can be filled with an explosive composition (i.e., explosives 126, 128) best tailored to the constraints of the volume (production filling considerations) and the needs of the subsystem (detonation wave velocity). Both pressed and pour cast methods are suitable. The imposition of a shaped leading shockwave in the axial core subassembly 160 through designed geometry enables the production of a forward effector that is largely independent of the warhead assembly it is installed into, enabling rapid adaptation of the warhead body geometry or composition to different delivery vehicles or target sets.

The tubular design of the axial core subassembly 160 lends itself to choosing the optimal high explosive composition and or manufacturing technique for a given application. The axial core high explosive material (e.g., the HE charge 128) may be comprised of a pressed or pour cast billet to provide the best performance for driving an EFP, SCJ, or flyer, while the exterior annulus charge (e.g., the HE charge 126) can be composed in such way to better drive fragments and conform to the complex geometries needed for integration into a variety of delivery platforms.

The warhead body 141 is designed in such a way as to expose a specific diameter opening in the forward end (opposite the initiation end) such that independent axial core subassemblies 160 can be inserted post warhead body fabrication, either at initial assembly or in the field. In some embodiments, the warhead body 141 is designed such that the fragmenting effects of the warhead are largely separated from the effects of the axial core subassembly 160 using wave shaping techniques and specially designed explosive formulations. Thus, modularity of the forward effects is retained without having to re-design or alter the external warhead body 141 and vice versa.

The preferentially fragmenting projectile rings 150 and warhead body liner 140 (internal or external to the rings 140 as defined by the delivery vehicle) form or constitute a composite structural element when bonded with structural adhesive 159, capable of carrying body loads of the warhead device and flight loads of the delivery vehicle in the same manner as a monolithic cast, machined, or scored warhead case. In some embodiments, this structural element is a metal (fragmenting rings 150) and polymer (body liner 140) composite structural element. The ring/liner composite structure 141 enables design modularity without significant changes in that the mounting points may be easily adjusted or added or removed to adapt to different vehicles. Ring 150 diameter, thickness, and internal and external diameter profiles may be adjusted to enable a rapid transition to different target sets (for the same delivery vehicle) or to different delivery vehicles. Further, the use of multiple fragment materials is enabled by the composite nature of the warhead body 141. A material suitable for perforation may be layered with a pyrophoric material to construct a multirole device. Design alternatives other than layering to provide similar effects are also described herein.

Installation of the rings 150 onto the warhead body liner 140 with a structural adhesive 159 enables the warhead body 141 to become a structural member and support its own weight and that of the explosive charge(s) 126, 128 inside during the application of transportation, launch, and flight loads.

The stepped warhead body liner 140 is designed in such a way as to enforce correct spacing of the rings 150 to ensure adequate bond line thickness of the structural epoxy 159.

It will be appreciated that the benefits and alternatives discussed above with regard to the warhead 120 likewise apply to the alternative embodiments described hereinbelow.

Figure 17:
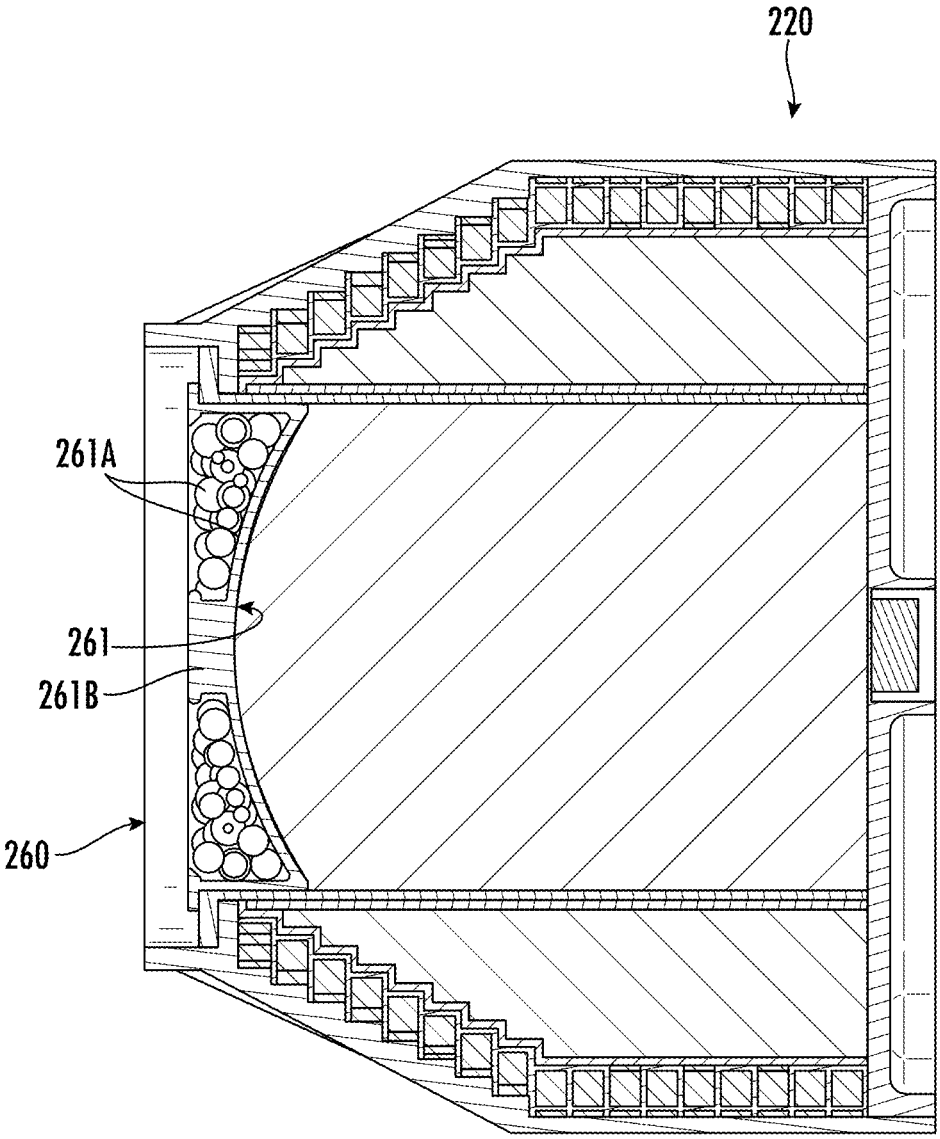
FIG. 17 is a cross-sectional view of a warhead according to further embodiments.

With reference to FIG. 17, a warhead 220 according to further embodiments is shown therein. The warhead 220 may be constructed and used in the same manner as the warhead 120 except as follows. The warhead 220 includes an axial core subassembly 260 corresponding to the axial core subassembly 160. The axial core subassembly 260 differs from the axial core subassembly 160 in that a fragment container (or "Frag Pack" insert forward effector 261 is provided in place of the EFP forward effector 161. The insert 261 includes a container 261B holding a plurality of loose projectiles 261A. The choice of forward effector type deployed in the warhead may depend on the mission. As discussed, the modularity of the warhead design can enable this choice to be made and executed after the manufacture of the warhead subassembly 130 and even post-manufacture (e.g., in the field).

Figure 18:
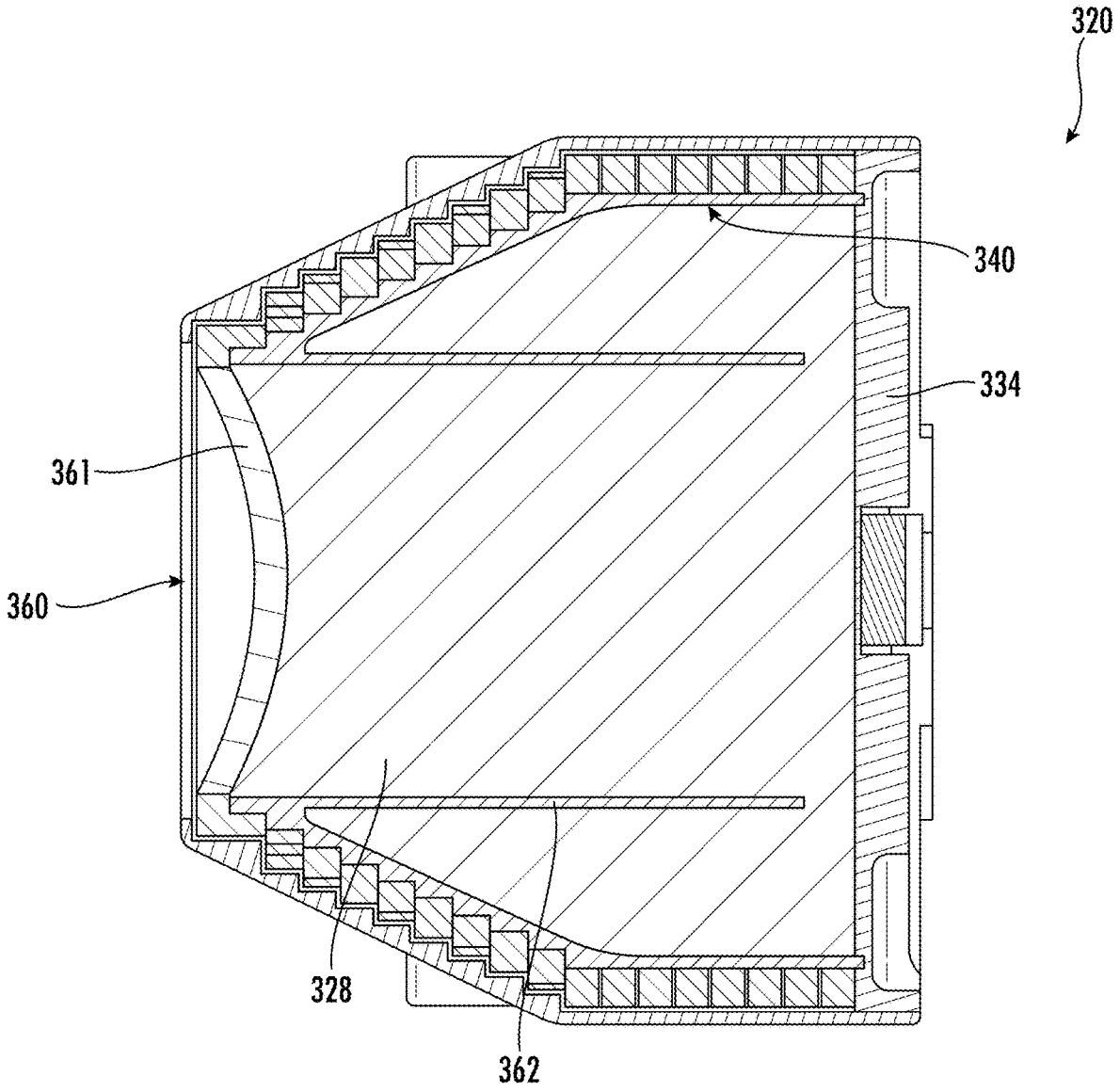
FIG. 18 is a cross-sectional view of a warhead according to further embodiments.

With reference to FIG. 18, a warhead 320 according to further embodiments is shown therein. The warhead 320 may be constructed and used in the same manner as the warhead 120 except as follows. In place of the axial core subassembly 160, the warhead 320 includes an integrated axial core subassembly 360. The axial core subassembly 360 includes an axial core charge 328 and a forward effector 361 corresponding to the axial core charge 128 and a forward effector 161.

The axial core subassembly 360 differs from the axial core subassembly 160 in that the axial core subassembly 360 does not include an axial core tube that is a discrete component from the warhead subassembly 330. Instead, the axial core subassembly 360 includes an axial core tube 362 that is integrated into the warhead body liner 340. In some embodiments, the axial core tube 362 is formed of the same material as the warhead body liner 340 and is manufactured as a single part with the warhead body liner 340. In some embodiments, the axial core tube 362 and the warhead body liner 340 together form a monolithic part. The axial core tube 362 may extend the full length of the warhead liner 340, or may be truncated so that it does not extend fully to the base 334 (e.g., as shown in FIG. 18).

Figure 19:
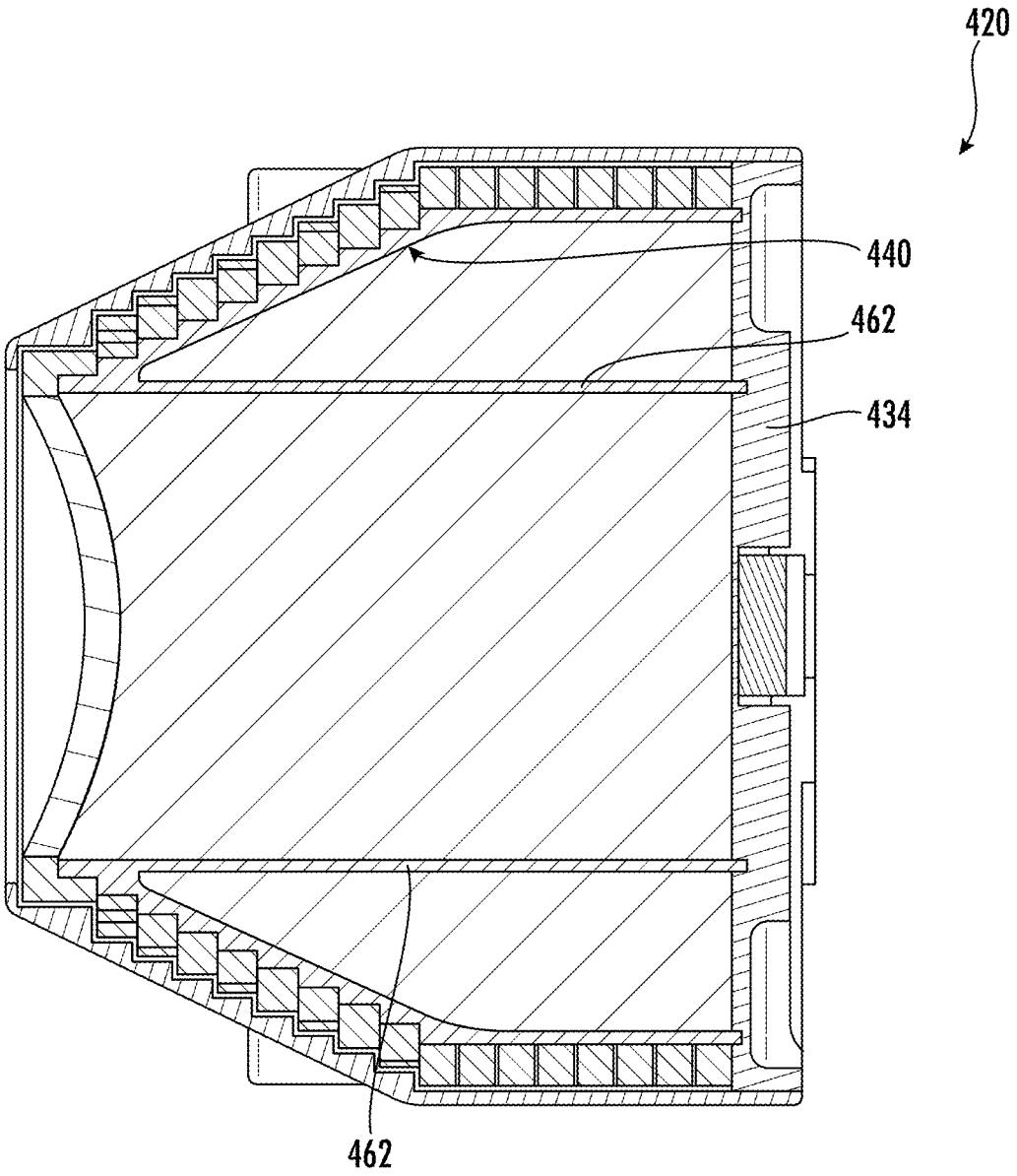
FIG. 19 is a cross-sectional view of a warhead according to further embodiments.

With reference to FIG. 19, a warhead 420 according to further embodiments is shown therein. The warhead 420 may be constructed and used in the same manner as the warhead 320 except as follows. In the warhead 420, the axial core tube 462 extends the full length of the warhead liner 440. In some embodiments and as illustrated in FIG. 19, the axial core tube 462 extends fully rearward and into the base 434.

Figure 20A:
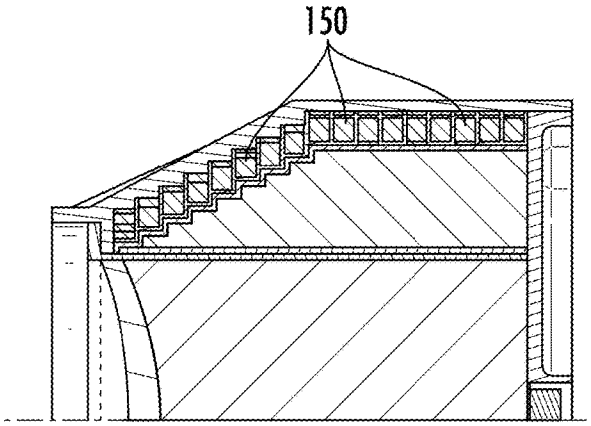
FIGS. 20A-20D illustrate alternative profile shapes for warheads according to some embodiments.
Figure 20B:
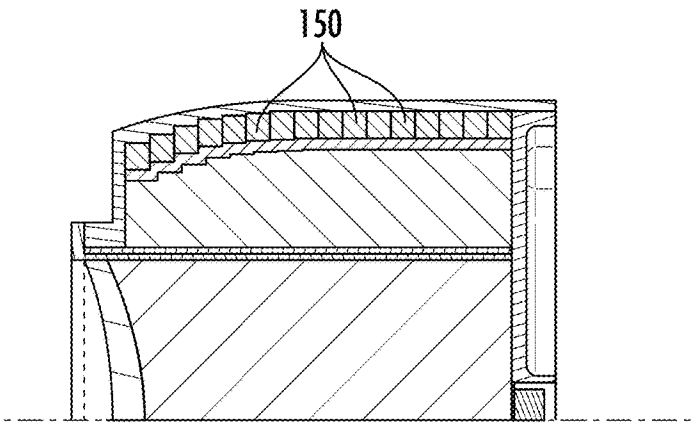
Figure 20C:
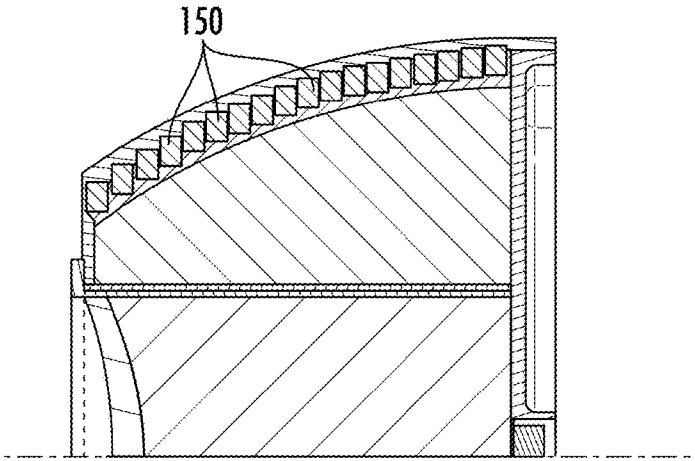
Figure 20D:
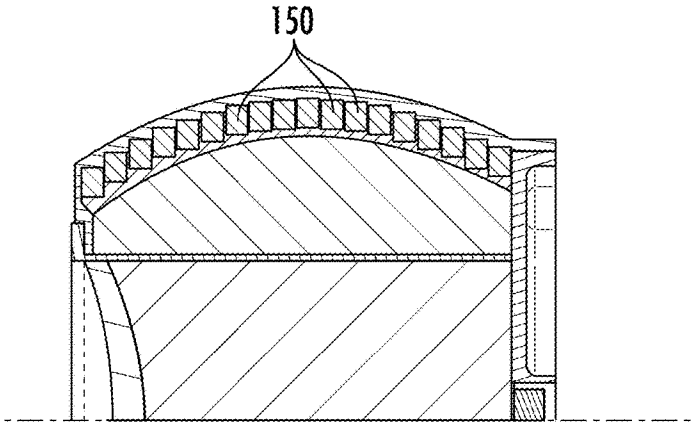

The preferentially fragmenting projectile rings 150 can be arranged in many geometries to generate desired fragment patterns, as illustrated in FIGS. 20A-20D. For example, the rings 150 can be arranged in a geometry matched to delivery vehicle shape. The rings 150 can be arranged in a geometry matched to target approach orientation. This may include an aft projection configuration as shown in FIG. 20D, for example. Note that the ring assembly size, shape or diameter does not influence the axial core subassembly installation.

Figure 21:
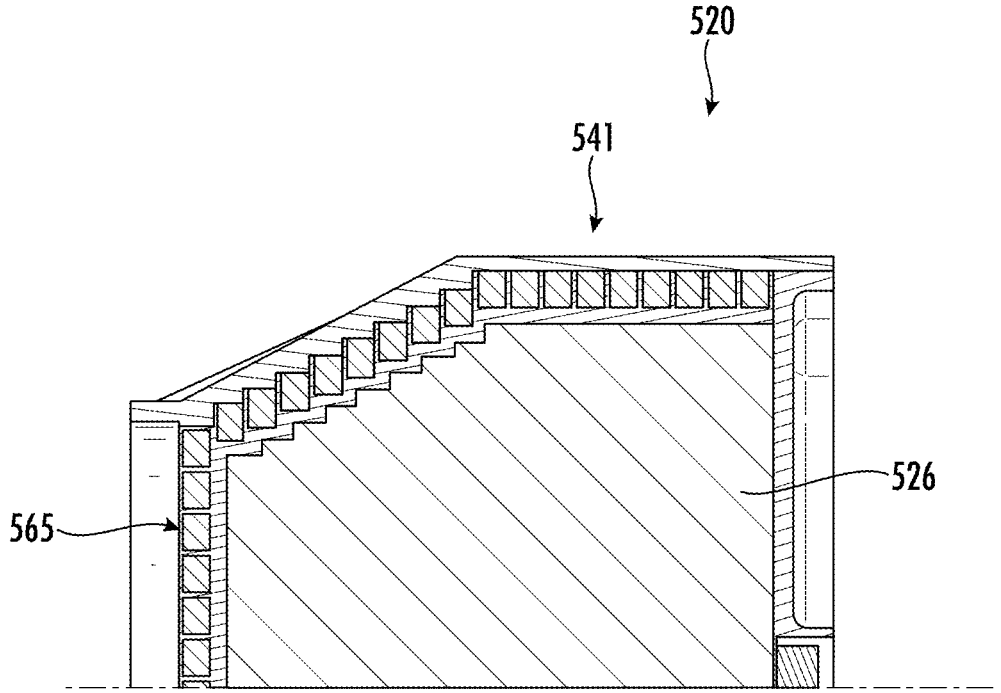
FIG. 21 is a fragmentary, cross-sectional view of a warhead according to further embodiments.

Composite warhead bodies as disclosed herein may also be employed with an axial core subassembly. For example, a warhead 520 as shown in FIG. 21 includes a composite fragmenting warhead body 541 and a high explosive charge 526 corresponding to the composite fragmenting warhead body 141 and the HE charge 126. In the warhead 520, a front projectile subassembly 565 is mounted on the forward end of the warhead 520. The front projectile subassembly 565 may include a set of concentric preferentially fragmenting projectile rings or a scored (e.g., with waterjet cut features) fragmenting disk.

Figure 22:
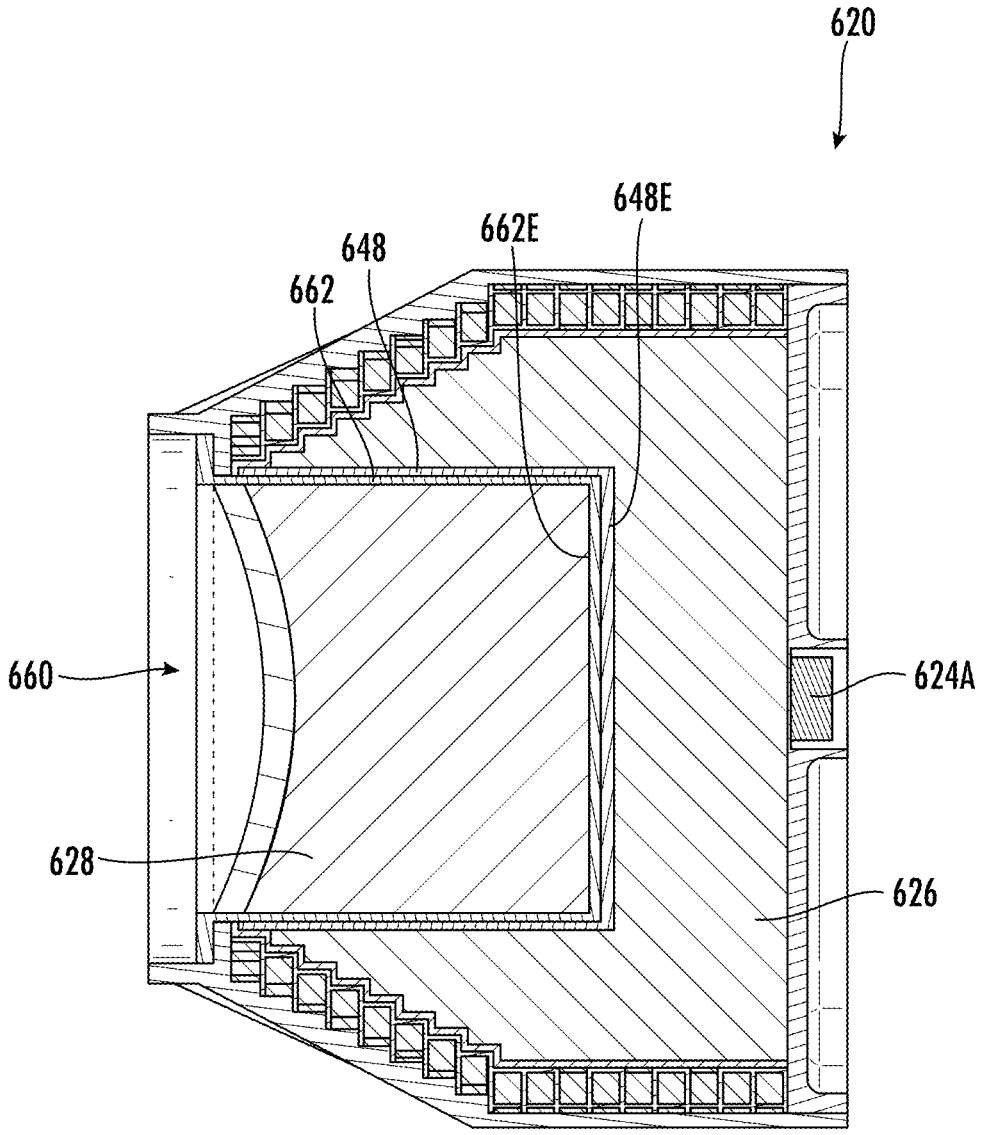
FIG. 22 is a cross-sectional view of a warhead according to further embodiments.

In some cases, the delivery vehicle or fragment projection needs may dictate that the axial core subassembly be truncated to give a continuous billet from the detonation point to the composite warhead body. In such a case, a blind cavity may be implemented to install the axial core subassembly. An example warhead 620 is shown in FIG. 22. The warhead 620 may be constructed and used in the same manner as the warhead 120 except that the slot wall 648 and the axial core tube 662 of the axial core subassembly 660 are provided with rear end walls 662E and 648E, respectively, so that the cavity 638 is a blind cavity. In this case, the detonator 624A is actuated to detonate the outer HE charge 626. The detonation shock wave from the detonated HE charge 626 detonates the axial core HE charge 628 at the rear end of the HE charge 628.

Figure 23:
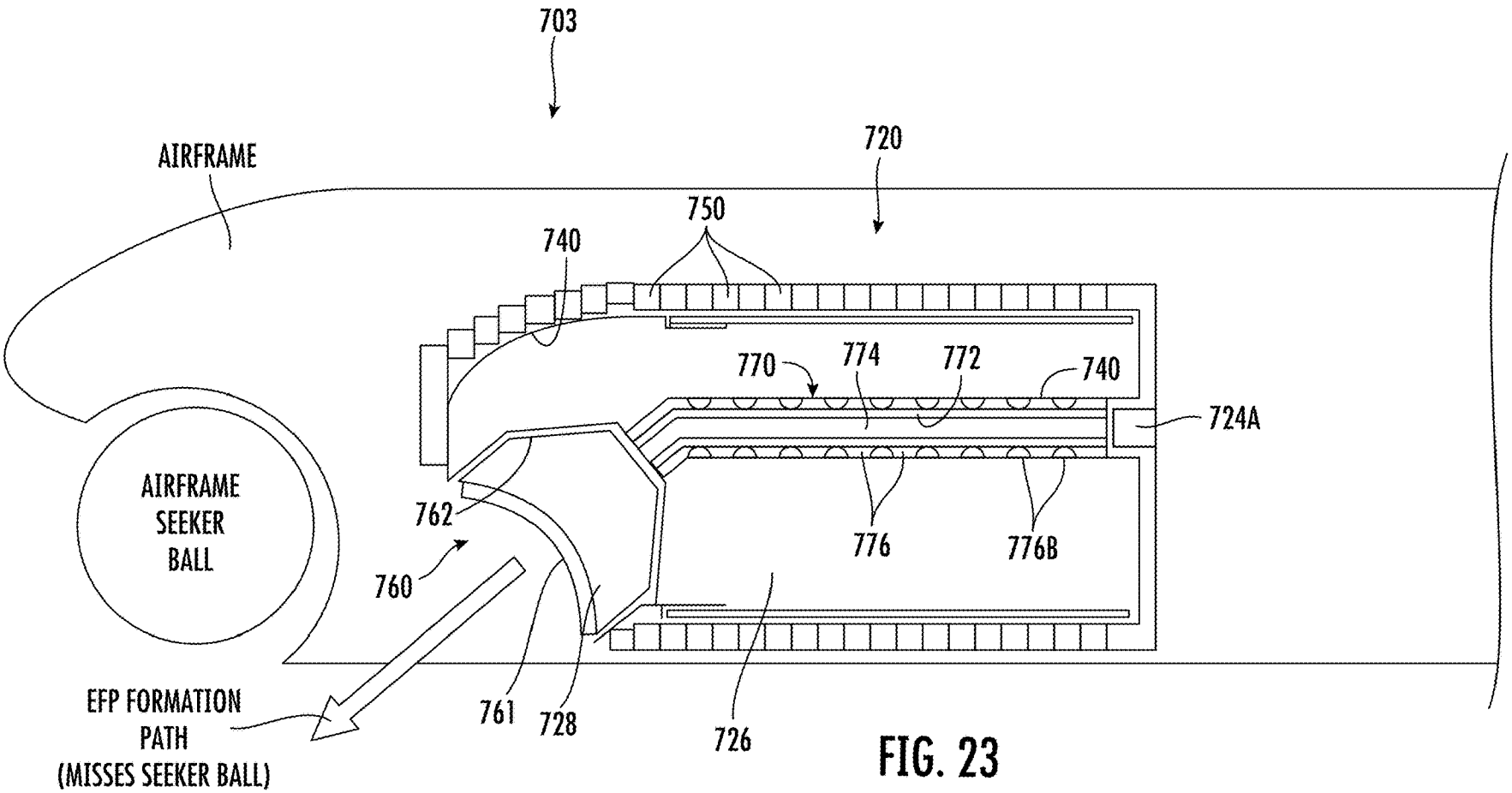
FIG. 23 is a schematic view of an installation including a warhead according to further embodiments.
Figure 24:
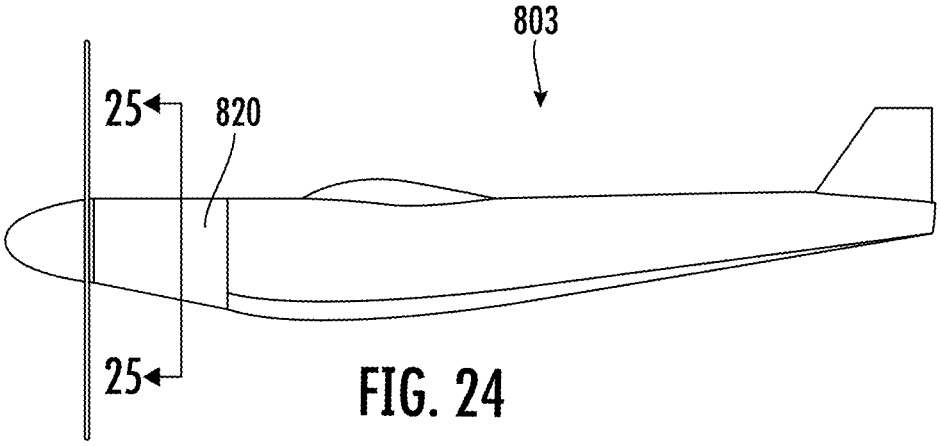
FIG. 24 is a side view of a munition including a warhead according to further embodiments.

The blind axial core configuration can also be modified to provide a non-axially aligned core subassembly. An example warhead 720 incorporating this feature is shown in FIG. 23 mounted in a vehicle 703. The warhead 720 includes a core subassembly 760 and a detonation channel 770 for operation. This configuration is advantageous because it allows EFP trajectories that do not interfere with axially-aligned airframe components, thereby maximizing EFP energy deposition onto targets.

The core subassembly 760 includes a core tube 762, a core HE charge 728, and a forward effector 761 corresponding to the core tube 162, the core HE charge 128, and the forward effector 161, respectively.

The detonation channel 770 includes a channel tube 772 and a detonation channel explosive charge 774. The detonation channel explosive 774 fills the channel tube 772.

In use, the HE booster 724A detonates the detonation channel explosive 774. The detonation shock wave from the detonated channel explosive 774 propagates through the channel tube 772 and in turn detonates the core explosive 728. The detonated the core explosive 728 projects the forward effector 761. The detonation shock wave from the detonated channel explosive 774 also detonates the warhead HE 726, which projects the warhead preferentially fragmenting projectile rings 750 as disclosed herein.

The detonation channel explosive 774 is designed to detonate prior to the bulk high explosive 726 in the warhead, to achieve proper EFP or other forward effector formation. In some embodiments, this is achieved by including strategically sized air gaps 776A and spacers 776B between the HE booster pellet 724A, the detonation channel 772, and the bulk warhead HE 726 such that the detonation wave traveling in the EFP detonation channel 770 forms earlier in time than the detonation wave traveling through the bulk HE 726 in the warhead. The spacers 776B may be integrated into the warhead body liner 740.

Figure 25:
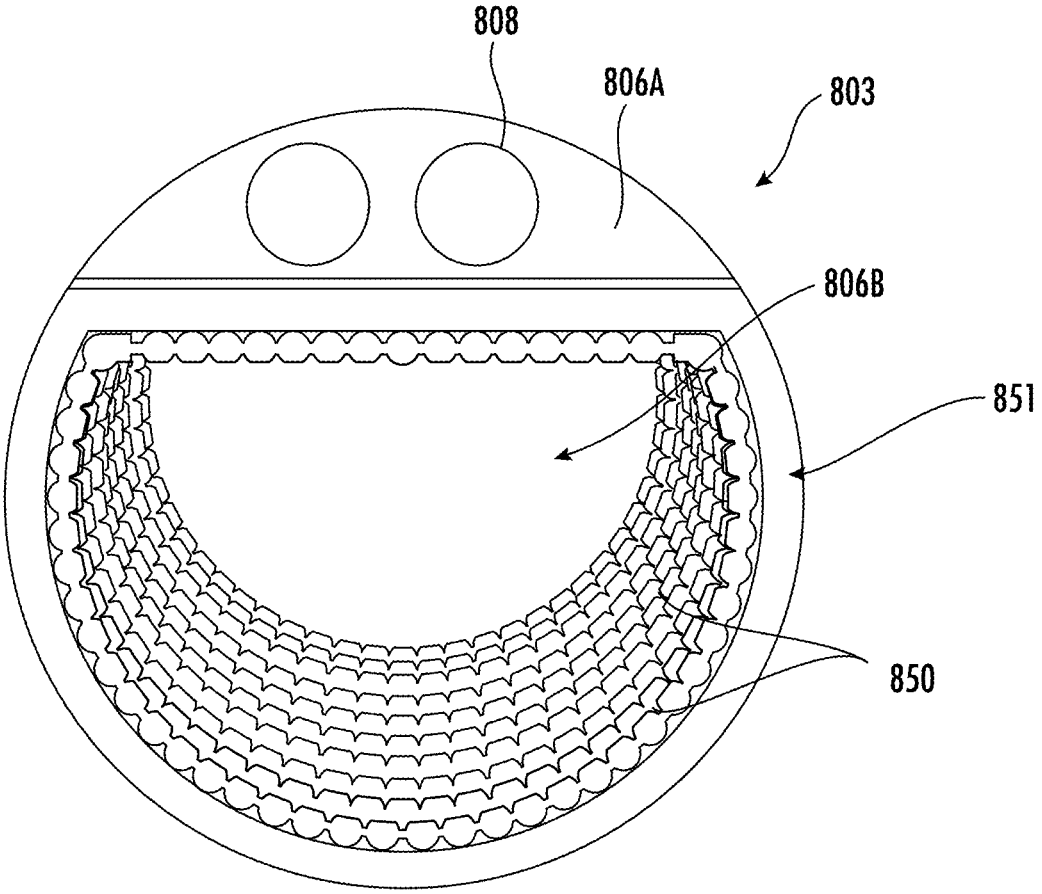
FIG. 25 is a cross-sectional view of the munition of FIG. 24 taken along the line in FIG. 24.
Figure 26:
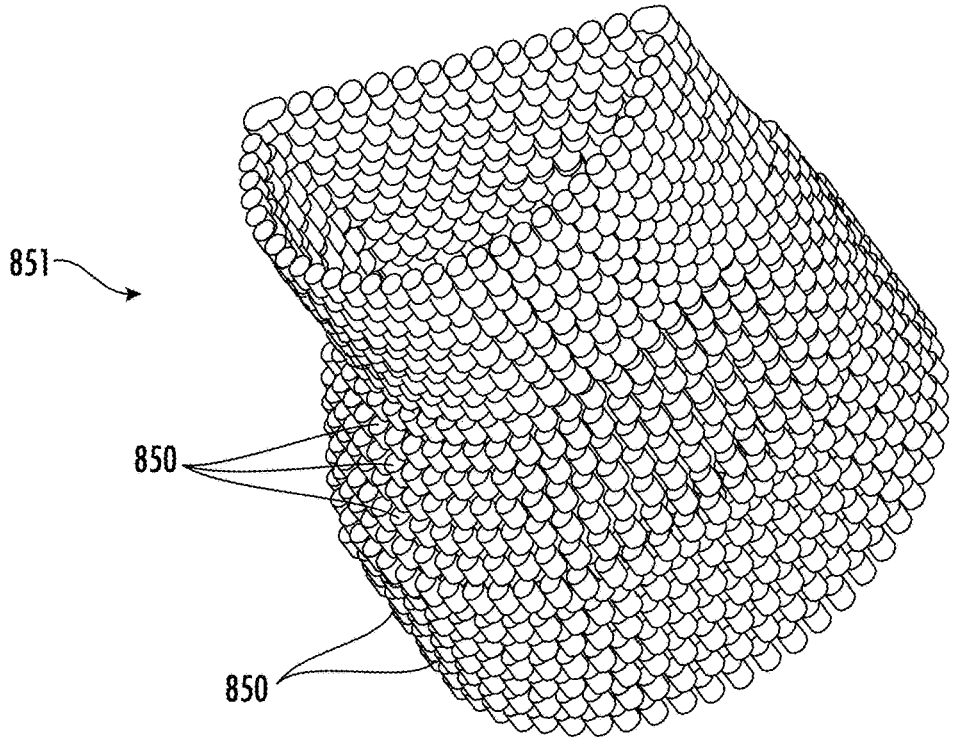
FIG. 26 is a perspective view of a set of preferentially fragmenting rings forming a part of the warhead of FIG. 24.
Figure 27:
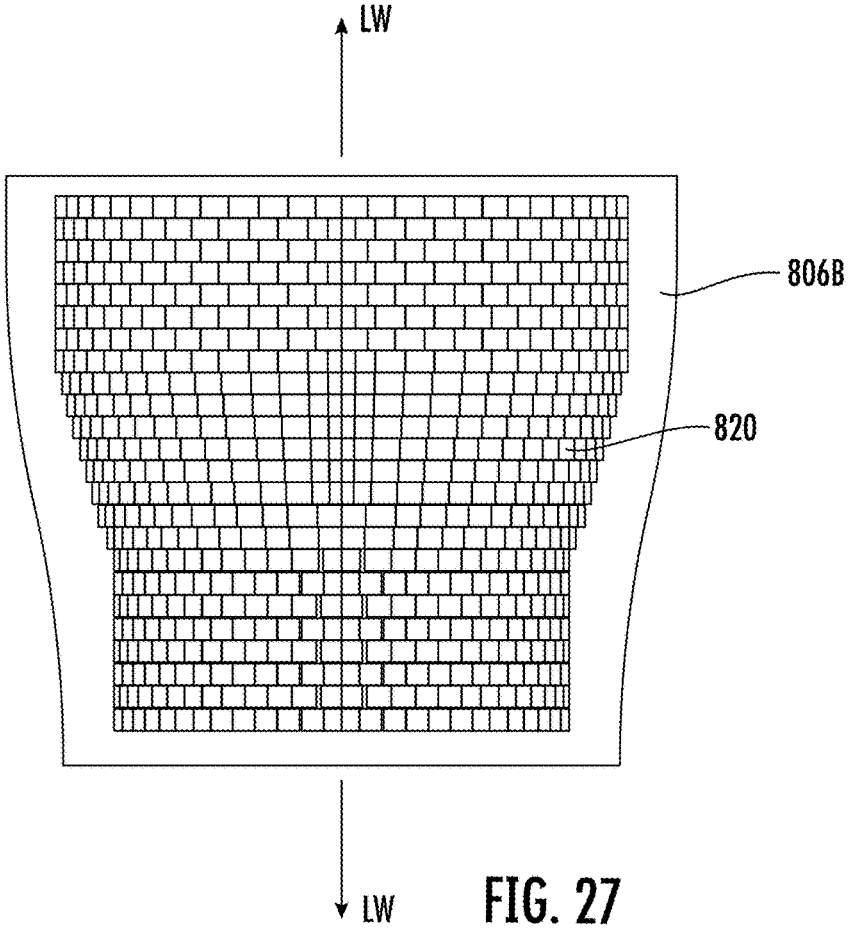
FIG. 27 is schematic view of the warhead of FIG. 24 in a warhead bay as viewed from below.

The flexibility of mounting and load carrying inherent in the composite fragmenting body according to embodiments of the technology also enables non-traditional (axially misaligned) placement of the warhead in the delivery vehicle. For example, FIGS. 24-28 illustrates a warhead 820 that can be mounted in a warhead bay 806B adjacent the payload bay 806A of an aerial vehicle 803. The rings 850 of the warhead 820 are rotationally asymmetric about the warhead longitudinal axis LW-LW to conform to the irregular shape of the warhead bay 806B. In FIGS. 26-27, only the set 851 of preferentially fragmenting projectile rings 850 of the composite fragmenting body are shown; however, it will be appreciated that the remainder of the warhead 820 and the composite fragmenting body may be constructed and operate in the same manner as described for other warheads and composite fragmenting bodies disclosed herein (e.g., the warhead 120 and the warhead body 141).

Figure 28:
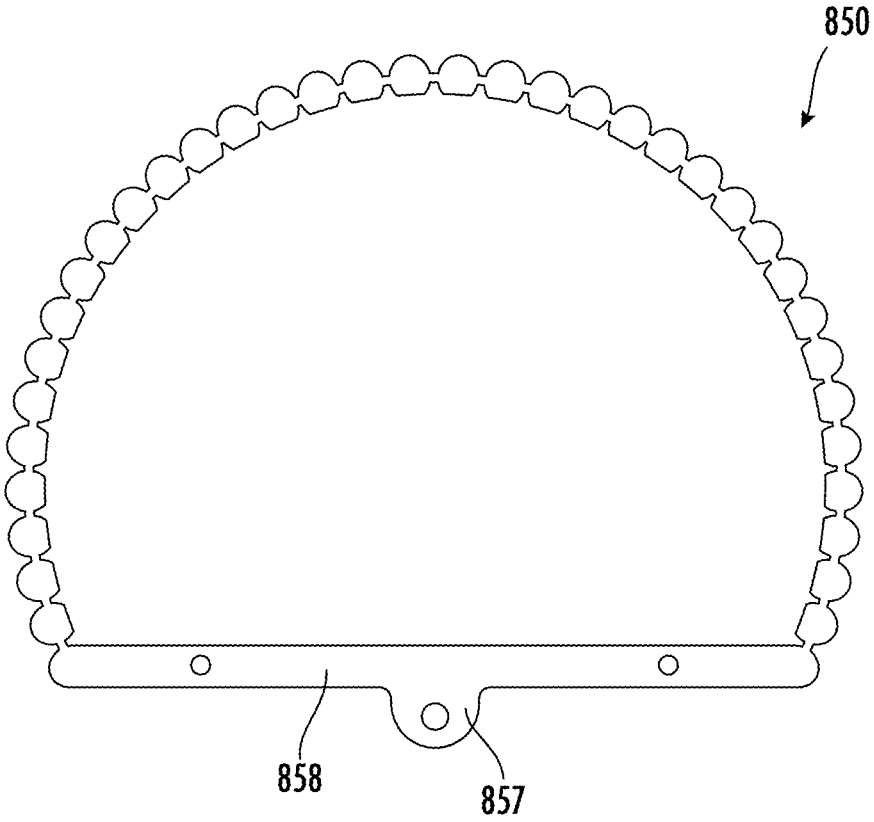
FIG. 28 is a perspective view of a preferentially fragmenting ring from the set of preferentially fragmenting rings of FIG. 26.
Figure 29:
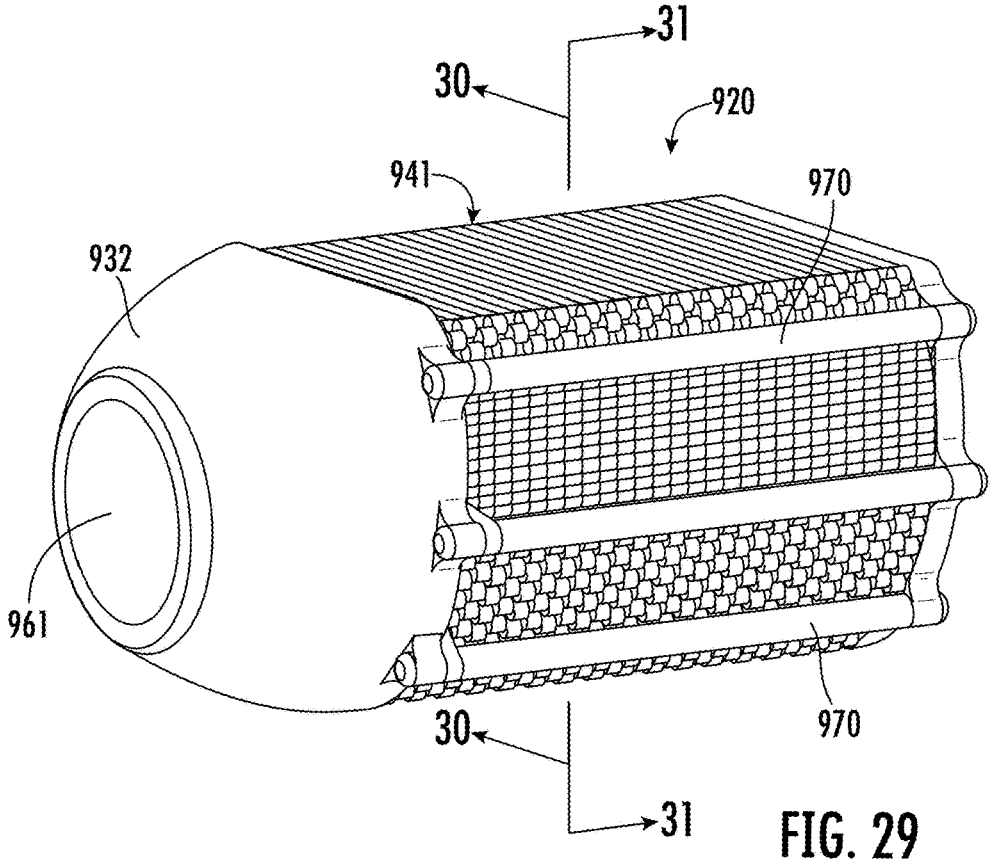
FIG. 29 is a front perspective view of a warhead according to further embodiments.
Figure 30:
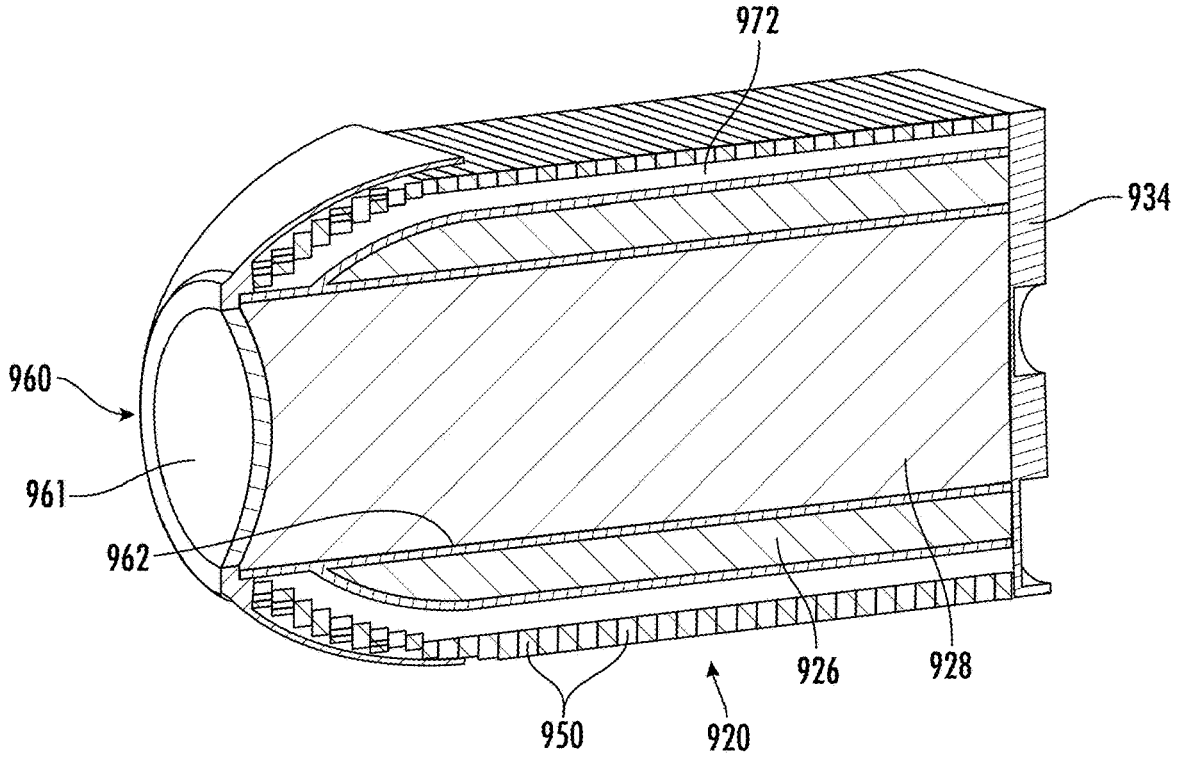
FIG. 30 is a cross-sectional view of the warhead of FIG. 29 taken along the line in FIG. 29.
Figure 31:
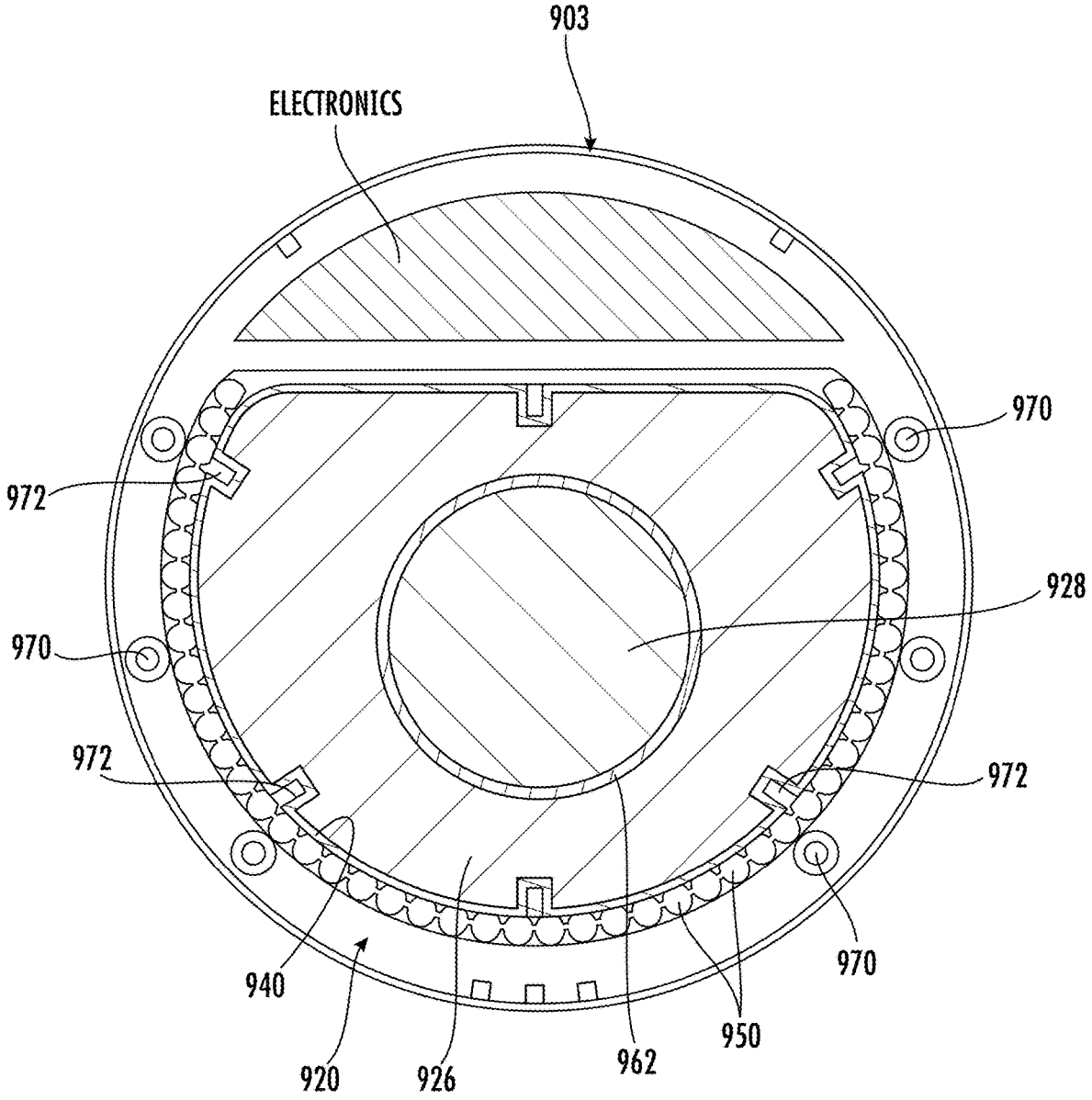
FIG. 31 is a cross-sectional view of the warhead of FIG. 29 taken along the line 31-31 in FIG. 29.
Figure 32:
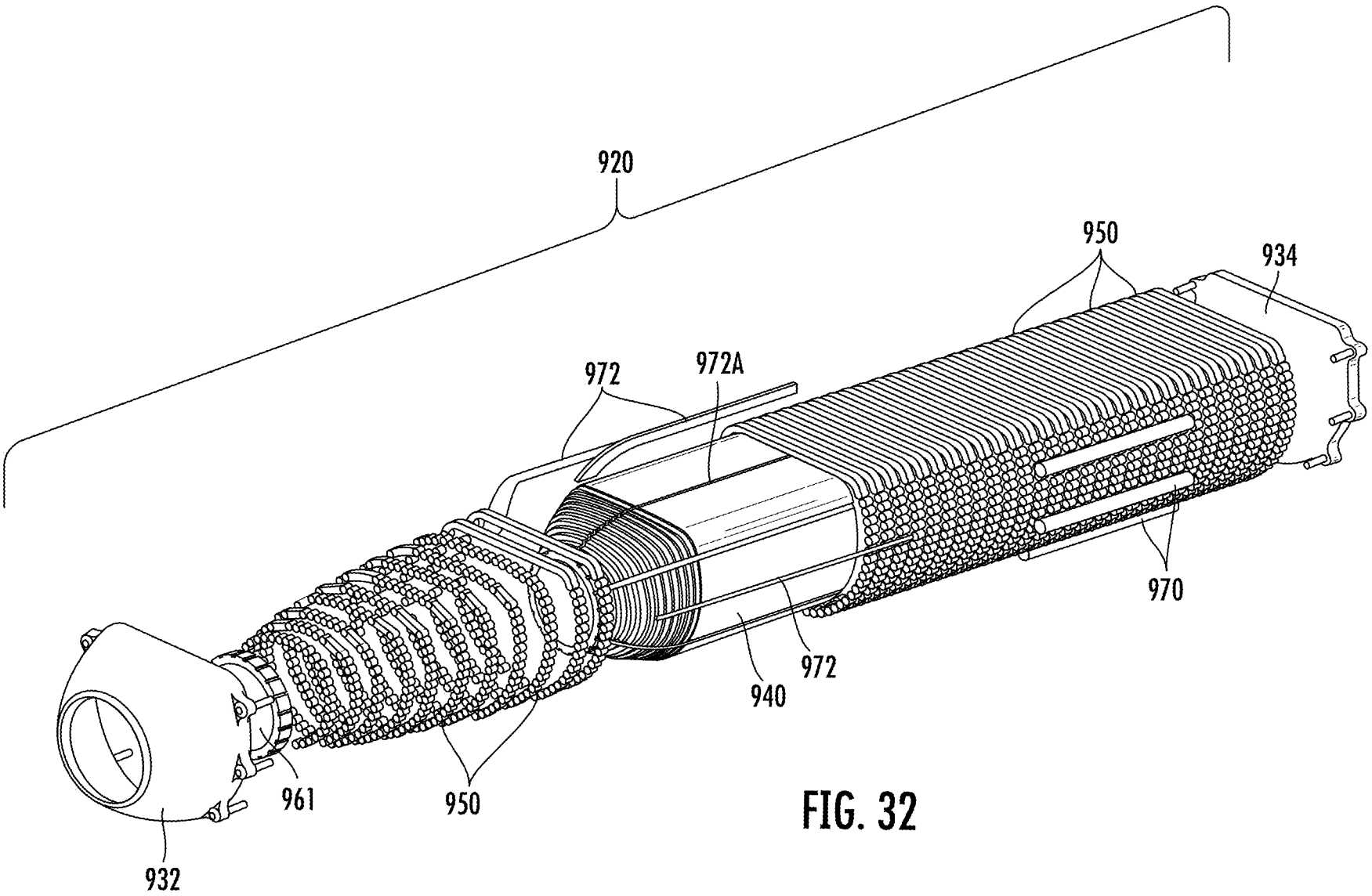
FIG. 32 is an exploded, front perspective view of the warhead of FIG. 29.
Figure 33:
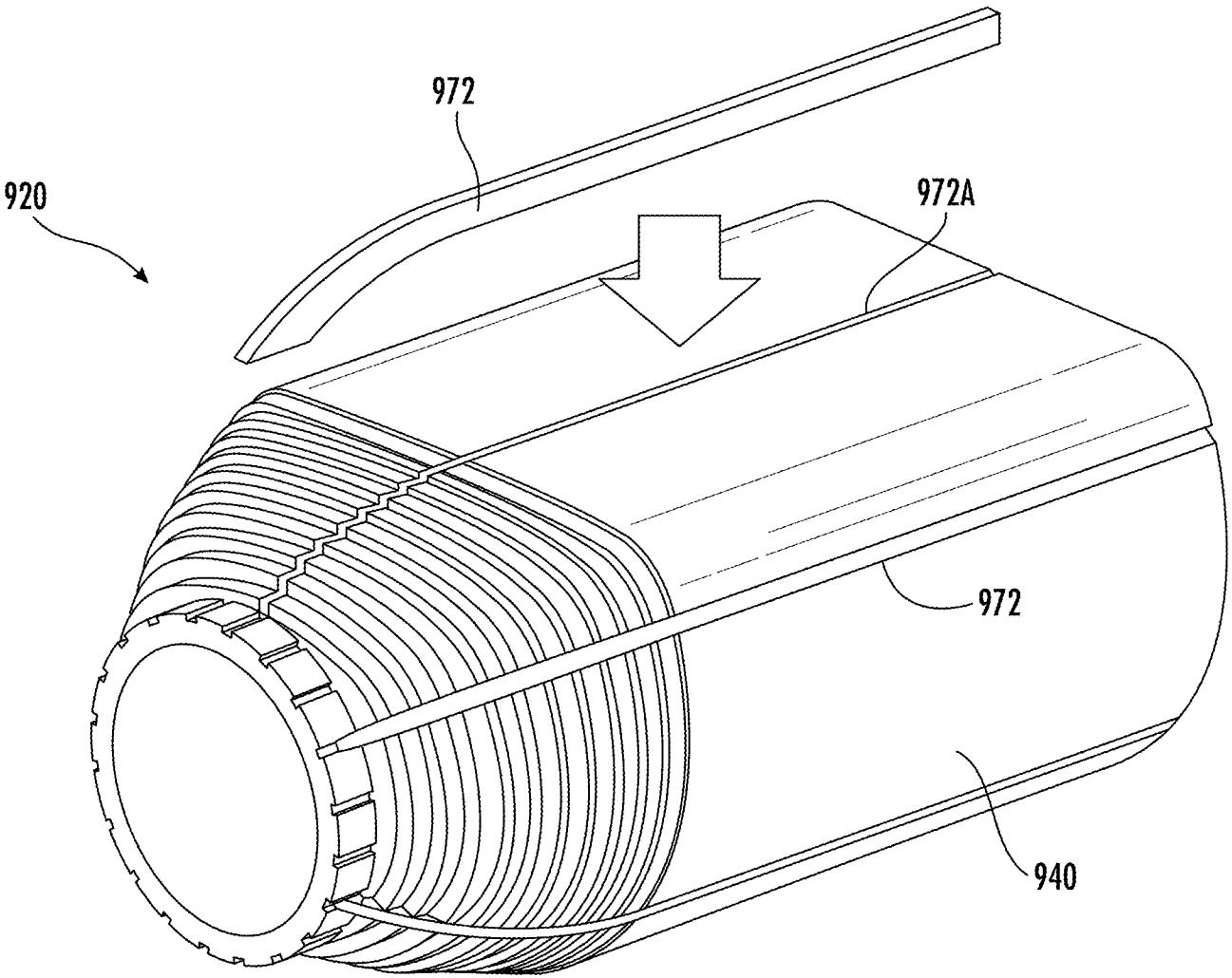
FIG. 33 is an exploded, front perspective view of the warhead of FIG. 29.

The mounting features on some or all the rings 850 allow co-location of components in the vehicle 803 alongside the warhead 820. The cross-section view in the top of FIG. 25 shows the warhead 820 placed below a chase 806A for avionics, ISR and targeting sensor packages, wires, and or structural elements 808. If desired, the section of the warhead adjacent to a payload bay can be fragmenting, or non-fragmenting, including only mounting features. For example, as shown in FIG. 28, one or more of the preferentially fragmenting projectile rings 850 can include a non-fragmenting section 858 that is positioned adjacent the payload bay.

FIGS. 29-33 illustrated a non-axial warhead installation according to further embodiments. The installation includes a vehicle 903 and a warhead 920. The warhead 920 may be constructed and operate substantially as disclosed herein for the warhead 120, except as follows.

The illustrated warhead 920 includes a composite fragmenting warhead body 941 (including fragmenting rings 950) and a body liner 940, a main explosive charge 926, an axial core subassembly 960 (including a core charge 928, a core tube 962, and a forward effector 961), a nose cover 932, and a base plate 934 corresponding to and constructed as described for the composite fragmenting warhead body 141, the HE charge 126, the axial core subassembly 160, the nose cover 132, and the base plate 934.

The warhead 920 also includes vehicle mount hardpoint members 970, and non-fragmenting projectile beams 972.

The vehicle mount hardpoint members 970 can serve as located to secure the warhead 920 to the vehicle 903. The vehicle mount hardpoints 970 may be rigid, elongate members or rods, for example.

The non-fragmenting projectile beams 972 are installed perpendicular to the preferentially fragmenting projectile rings 950. In some embodiments, the projectile beams 972 are seated in grooves 972A defined in the body liner 940. Upon warhead detonation, these projectile beams 972 will not fragment. Instead, upon warhead detonation, these beams 972 will yield large, continuous fragments intended to deposit more energy to the target compared to the smaller fragments created by the rings 950.

Figure 35:
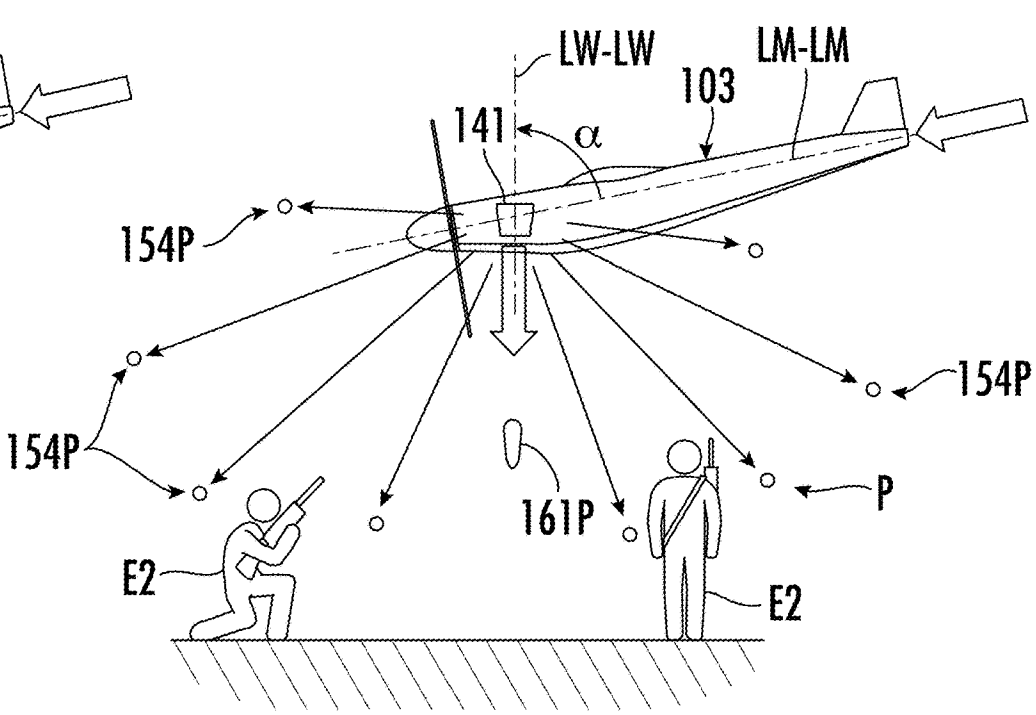
FIGS. 34 and 35 are schematic views illustrating operations of the warhead of FIG. 1.
Figure 34:
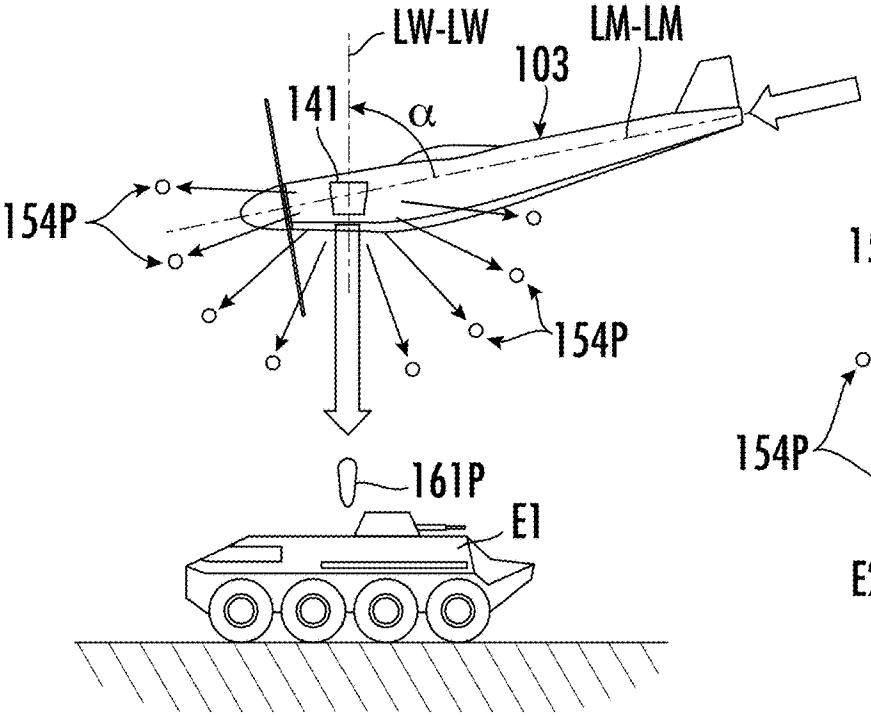

Warheads as disclosed herein can be selectively oriented relative to the carrying platform as desired. For example and as illustrated in FIGS. 34 and 35, the warhead body 141 can be oriented in the vehicle 103 such that the warhead longitudinal axis LW-LW is pitched relative to the roll axis LM-LM of the delivery vehicle 103. This mounting orientation enables the use of different fly over shoot points to: shoot down vertically above armored targets with an EFP, SCJ, or flyers (as shown in FIG. 34); enable a more appropriate fragment projection pattern for a given delivery vehicle approach angle; and/or use lighter EFPs or SCJ designs by aiming the munition to avoid passing through denser delivery vehicle components (ISR platforms, cameras, seeker assemblies, etc.).

Warheads according to embodiments of the technology may incorporate or enable a number of design alternatives, including the following.

The composite fragmenting warhead may include a removable form liner. Once the structural adhesive between the preferentially fragmenting projectile rings cures, the interior ring surfaces (e.g., the ring surfaces 152C) are exposed. Then a second, inner an asphalt/polyurea/polymer liner can be sprayed in before the composite warhead body is filled with the warhead explosive (e.g., the explosive 126; e.g., a castable explosive). The sprayed in second liner may be formed of asphalt, polyurea, and/or polymer, for example.

The composite fragmenting warhead may include an external liner or aeroshell which performs the alignment function. The preferentially fragmenting projectile rings are affixed to the external liner with structural adhesive to form the composite warhead body. A spray in liner as described above is then added before filling with the warhead explosive (e.g., the explosive 126; e.g., a castable explosive).

The composite fragmenting warhead may include preferentially fragmenting projectile rings having different structures or compositions from one another within the same composite warhead body. The preferentially fragmenting projectile rings of a given composite warhead body may vary from one another with: alternating materials (e.g., perforating preferentially fragmenting projectile rings and pyrophoric preferentially fragmenting projectile rings); graded material properties; preferentially fragmenting projectile rings with different nominal fragment sizes; preferentially fragmenting projectile rings with different wall thicknesses; and/or preferentially fragmenting projectile rings with different plate thicknesses.

Figure 37:
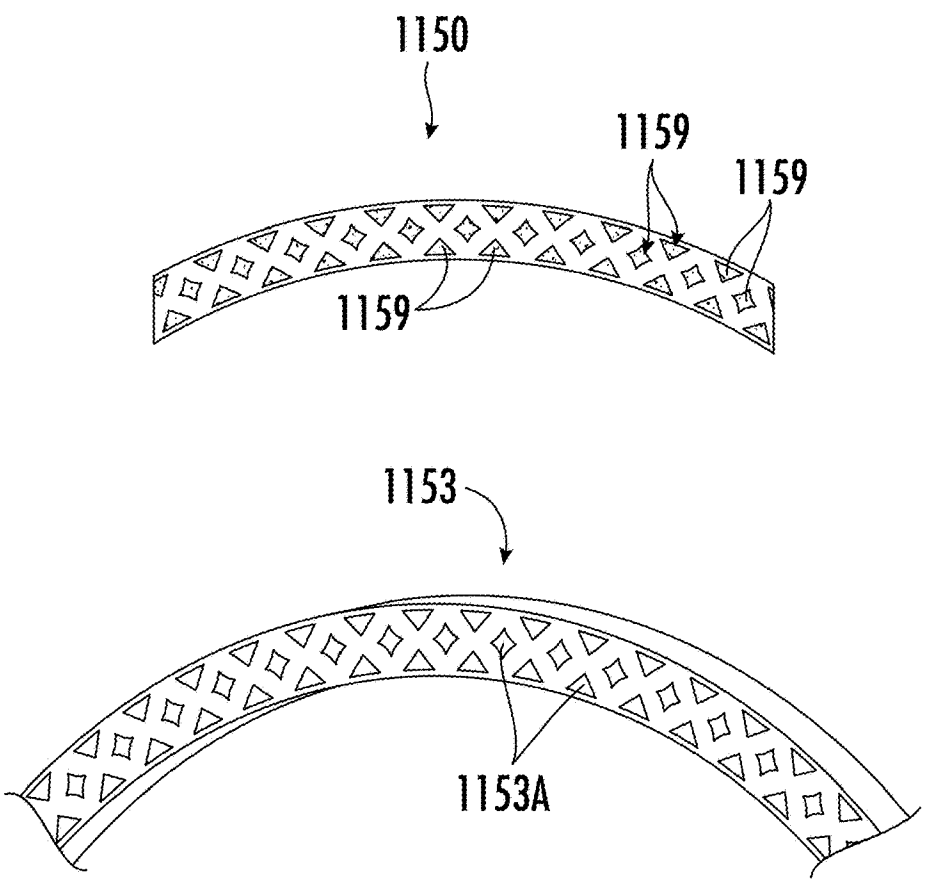
FIGS. 36-39 are fragmentary views of preferentially fragmenting rings according to further embodiments.
Figure 36:
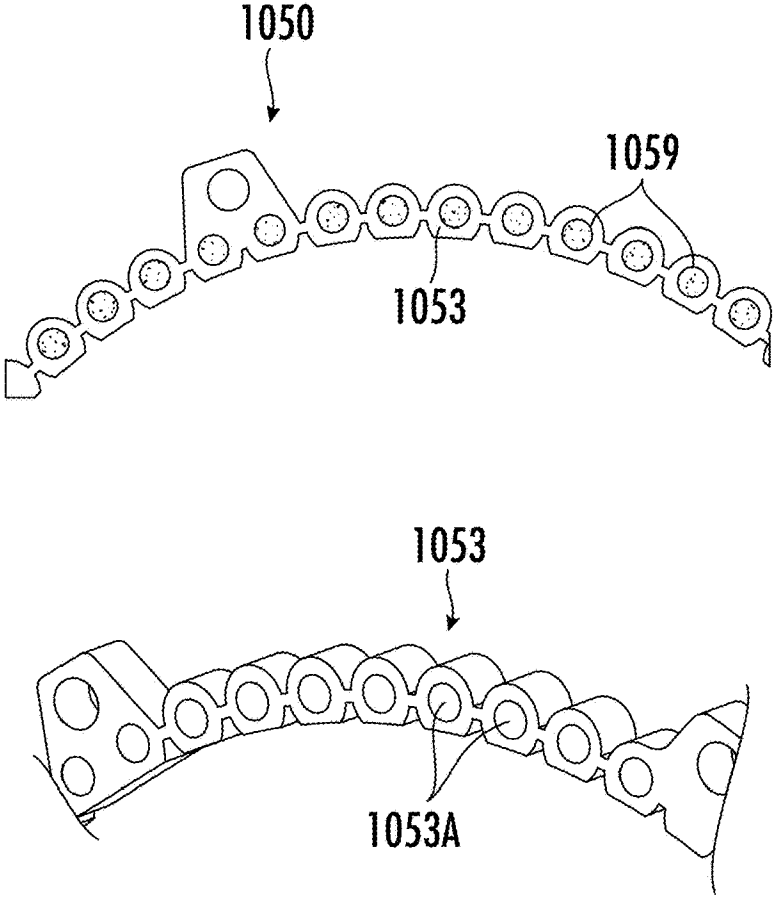

The preferentially fragmenting projectile rings may include reactive fill in each preferentially fragmenting section, to deliver a range of effects. For example, FIGS. 36 and 37 shows preferentially fragmenting projectile rings 1050, 1150 each including a metal, fragmenting base component or ring 1053, 1153 and reactive fills 1059, 1159. The reactive fills 1059, 1159 are contained in cavities or voids 1053A, 1153A defined in the base component 1053, 1153. The reactive fill 1059, 1159 may be a proprietary, commercially available high density intermetallic reactive material blend, for example.

Figure 38:
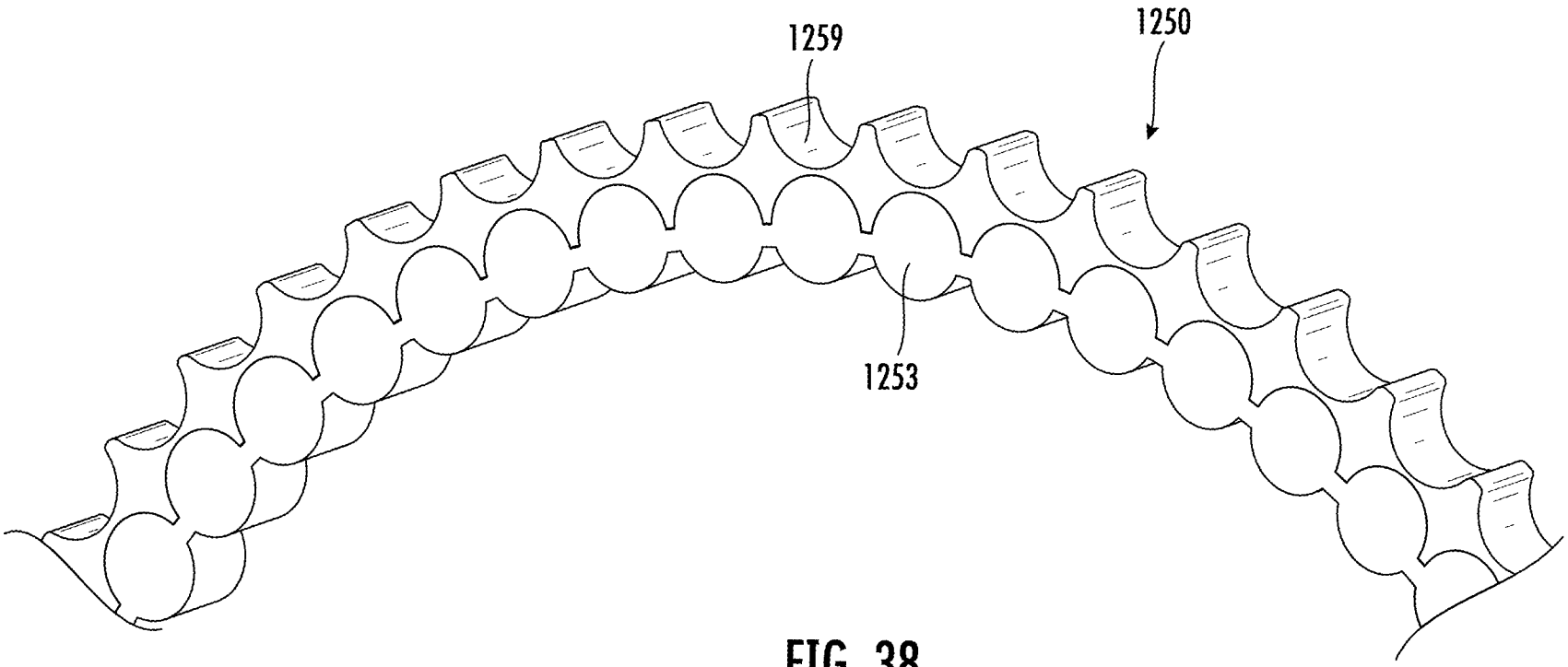

The preferentially fragmenting projectile rings may be cut from a pyrophoric material (such as titanium or magnesium alloy plate) to deliver fire-start effects due to their pyrophoric nature. Rings from these materials might also be interleaved with non-pyrophoric (e.g., steel) rings in the assembly to provide multiple effects in a single warhead. An alternative geometry to achieve this function is shown in FIG. 38, where multiple materials could be sleeved together in each ring layer. FIG. 38 shows a single ring layer 1250 of a composite warhead body. This ring layer 1250 includes an inner, non-pyrophoric fragmenting metal ring 1253 and an outer pyrophoric metal ring 1259.

Figure 39:
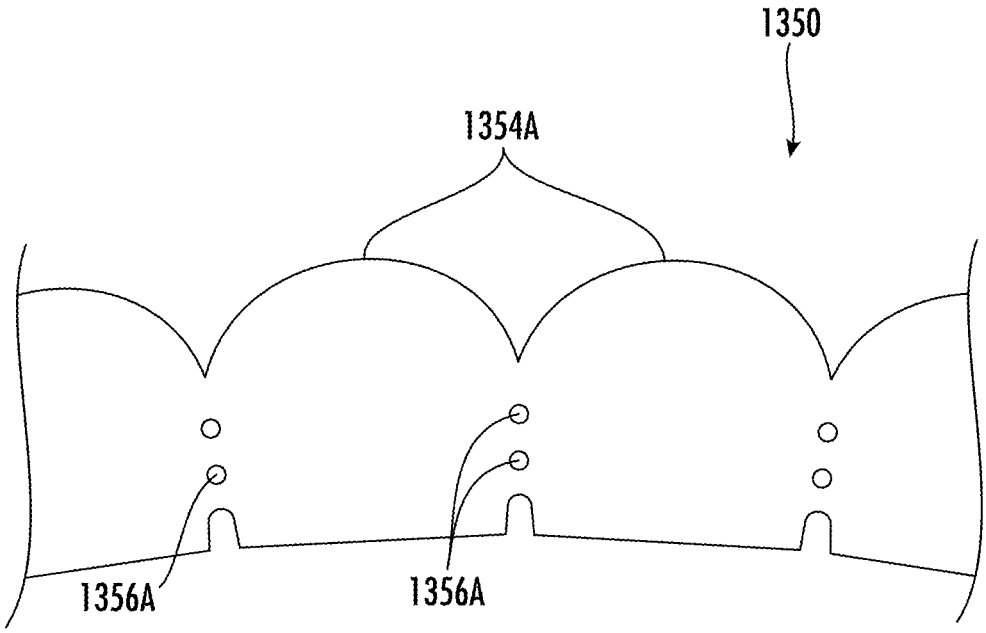

A preferentially fragmenting projectile ring 1350 according to further embodiments is shown in FIG. 39. The ring 1350 is formed (e.g., cut) to include pre-formed flat cut geometries and rounded fragment surfaces 1354A on the ring outside diameter to reduce the number of potential flat face impacts against a target of interest. The ring 1250 also includes perforations 1356A formed using water jet pierce operation, for example, to provide additional stress concentrations to ensure desired break up. In some embodiments, the perforations 1356A have an inner diameter in the range of from about 0.010 inch to 0.050 inch.

By combining the internal contour capabilities of most flat cutting methods with pyrophoric materials, warheads as described herein can give added advantages of pre-defined corners for improved aerodynamic drag induced ignition.

Alternative preferentially fragmenting projectile ring geometries are enabled by simply changing the internal and external shapes of the rings to improve fitment in differently shaped delivery vehicles and improve explosive charge carrying capacity for a given volume. Examples include oval rings, dimples for avoiding delivery vehicle structural members, or liners that enable rings to be placed in alignments other than co-axial with each other to better fill payload volumes (for example, as discussed above with reference to FIGS. 24-28).

Figure 40:
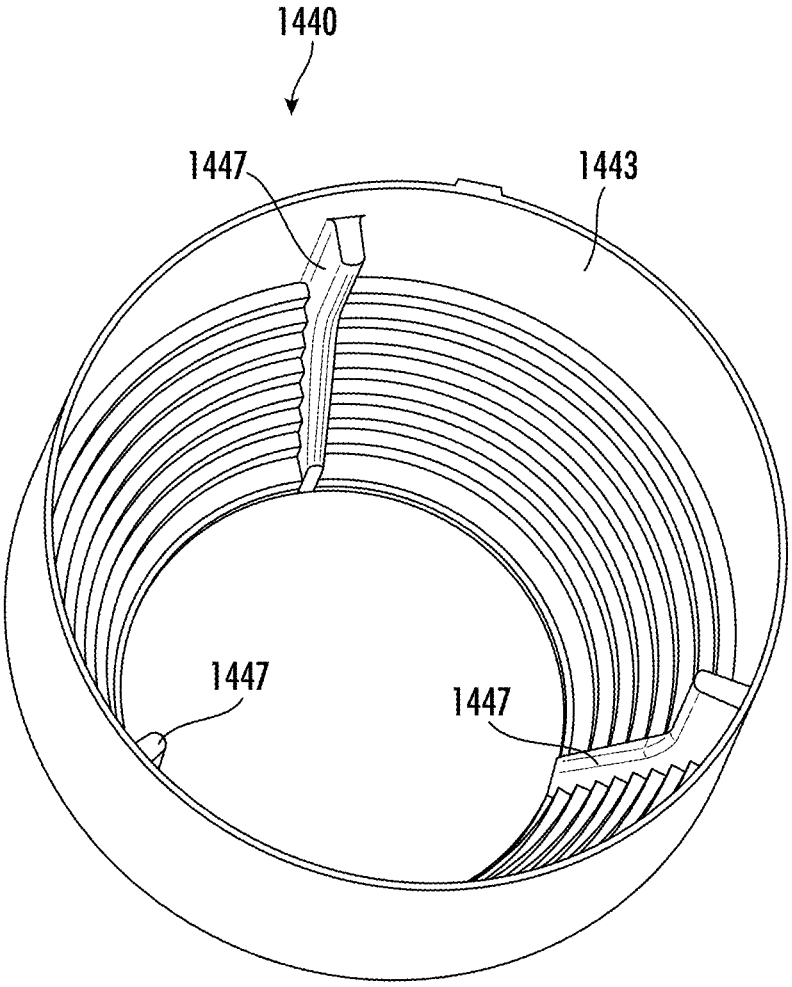
FIG. 40 is a rear perspective view of a body liner according to further embodiments.

With reference to FIG. 40, a warhead body liner 1440 according to further embodiments is shown therein. The warhead body liner 1440 may be used in place of the warhead body liner 140, for example. The warhead body liner 1440 may be constructed in the same manner as the warhead body liner 140 except that the warhead body liner 1440 further includes integral reinforcement rib features 1447. The rib features 1447 serve to make the liner 1440 stronger and more rigid to satisfy the required load and assembly tolerance requirements.

Warheads and composite warhead bodies according to embodiments of the technology can be manufactured using novel methods to improve cost, manufacturability, flexibility and/or performance.

Current fragmenting warhead body manufacturing methods (versus methods for manufacturing preformed fragments in a sleeve or container of some variety) employ a machining or forming process to impart imprints, score lines, channels, or grooves in a substantially monolithic structure to create stress concentrations for preferential case break up. Even with preferential break up patterns imprinted, actual fragment formation is largely inconsistent in both size and spatial distribution. Specifically, cylindrical warheads with both axial and circumferential grooves still have a tendency to create axial strips in the direction of detonation. This leaves target areas potentially unengaged or engaged with fragments inadequate to perform the intended function. Further, complex warhead body geometries (non-cylindrical or partially cylindrical) require specialized machine tools, dies, 3D-5D multi-axis CNC programming, alignment, and specialist personnel to fabricate. Cycle time for complex geometries where large quantities of material must be removed from a billet drives high per unit cost.

Composite warhead bodies as disclosed herein overcome or avoid the problem of inconsistent fragment formation in monolithic cylindrical warheads by breaking the cylindrical warhead body into ring like segments and integrating them with a warhead body liner along the axis of the warhead body. The ring/liner composite construction method enables complex geometry by varying the thickness, diameter, material of construction, and alignment of the preferentially fragmenting projectile rings. Indentations for preferential fragmentation in the circumferential direction are easily implemented. Flat cutting techniques, such as abrasive waterjet and laser cutting are commoditized manufacturing processes well-suited for this manufacturing method. High volume production using stamping techniques may be used. Material in sheet, strip, plate, or panel form is relatively cheap compared to large billets. Flat cuts also allow for nesting of smaller preferentially fragmenting projectile rings inside of larger ones to ensure optimal use of material stock, further reducing costs.

According to some methods for forming the preferentially fragmenting projectile rings, raw material in the form of sheet, plate, strip, or panel is cut into ringlike forms via a flat cut patterning process such as water jet or laser cutting. The ringlike forms become the preferentially fragmenting component of the composite warhead body. This method does not use dedicated specialized tooling or require the use of mechanical forming techniques to produce a warhead body. This enables rapid adaptation of a warhead design (characterized by explosive mass, nominal diameter, fragment size and shape, and case material) into multiple platforms by simply adding or moving mounting tabs which are located on some of the rings. Further, the use of brittle, non-metal, and/or non-machinable materials for fragmentation bodies is enabled since no forming is required.

Multi-role weapons may be created by the inclusion of multiple ring material types within a single composite warhead body. A polymer liner or aeroshell may be employed with a mating feature to ensure correct alignment of rings during warhead body assembly (in the manner of a keyway).

Handling of flight and launch loads is enabled by the use of a structural adhesive to join the preferentially fragmenting projectile rings to each other and the liner to create a metal/plastic composite warhead body.

Fragment size, shape, and mass is determined by cutting indentations on the inside and outside diameter of each ring as determined by the target of interest. Additional pierce features can be used to further tune ring break up. Larger fragment geometries may be implemented with a through thickness hole to carry payloads such as reactive materials.

A plastic or polymer inner warhead body liner or external shell is employed to hold and align the preferentially fragmenting projectile rings during the assembly process and form part of the composite structural load carrying assembly (i.e., the composite warhead body). The plastic liner or shell may be imprinted with a groove or projection that mates with a corresponding feature in the rings to provide a rotational alignment reference if needed.

Mounting tabs can be implemented on some of the fragment ring components to enable integration with a variety of delivery platforms.

The composite warhead body construction method is immediately scalable in both size and production volume using the same tools. Changes to the fragment and shapes and score locations do not materially impact the manufacturing or assembly methods. Further, adaptations to future platforms can be made without additional process development for fragment formation.

The modular, scalable design of warheads as disclosed herein may provide, depending on the implementation, a number of options, advantages or benefits, including the following. No specialized tooling is necessary in the production of any component. All processes used to produce components are capable of a range of component sizes. Warhead subsystems may be scaled to delivery vehicle size, weight as well as adapted to specific approach trajectories. The axial core subassemblies (e.g., axial core subassemblies 160, 260, 660, 760) can be interchanged without influencing performance of the fragmenting warhead body (e.g., the warhead body 141).

Different energetic fills may be provided in the axial core subassembly (e.g., in the cavity 166) than in the remaining warhead volume (e.g., in the cavity 136). The axial core subassembly is amenable to either pressed or pour cast explosives.

The composite nature of warhead body can enable the warhead body 141 to carry structural loads via integrated mounting points.

Many warhead body or case design options or alternatives are available or may be incorporated in warheads as disclosed herein.

The warhead may include variable fragment sizes. For example, some rings 150 may have different size fragment sections 154 than other preferentially fragmenting projectile rings on the same warhead 120.

The warhead may include alternating material types. For example, some rings 150 may be formed of different materials than other rings on the same warhead 120.

As discussed above, the warhead may be shaped such that it is conformal to irregular payload bay designs.

The warhead may incorporate reactive materials into the projectile rings 150.

The warhead may include multiple preferentially fragmenting projectile rings 150 nested on the same layer (e.g., a preferentially fragmenting outer ring mounted concentrically over an inner preferentially fragmenting ring).

The shapes of the fragment sections of the preferentially fragmenting projectile rings can be tuned. The composite nature of the warhead can provide integrated perforation and reactive fragment projection.

The warheads as disclosed herein (e.g., warhead 120) can be constructed as a single, integrated, modular assembly that can be simply attached and connected to other components of the munition. The housing in the form of the fragmenting composite warhead body 141 provides load structural carrying capacity with minimal parasitic mass/volume. External housings or fairings may be used or may not be necessary. The warhead can be configured as a "drop-in" replacement for existing warheads so that existing munition designs can be repurposed or retrofitted with the warhead. The warhead is scalable and could be sized to fit into missile systems of different types and shapes. Warheads according to embodiments of the technology can be constructed to be of near identical weight, volume and center of gravity to the production warheads they are designed to replace.

Some embodiments of the technology may incorporate a composite fragmenting warhead body as described herein without the modular axial core subassembly aspect and, in some embodiments, without a forward effector.

Some embodiments of the technology may incorporate a modular axial core subassembly as described herein without the composite fragmenting warhead body aspect. In that case, the warhead outer projectile source may be an array of pre-formed fragments or one or more preferentially fragmenting members (e.g., a fragmenting casing).

In the above description of various embodiments of the present disclosure, aspects of the present disclosure may be illustrated and described herein in any of a number of patentable classes or contexts including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "circuit," "module," "component," or "system." Furthermore, aspects of the present disclosure may take the form of a computer program product comprising one or more computer readable media having computer readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages, such as MATLAB. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many alterations and modifications may be made by those having ordinary skill in the art, given the benefit of present disclosure, without departing from the spirit and scope of the invention(s). Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A warhead comprising:

a tubular warhead body including a plurality of serially arranged preferentially fragmenting projectile rings;

a warhead high explosive in the warhead body;

an outer warhead subassembly defining a core slot, the outer warhead subassembly including:

the warhead body; and the warhead high explosive; and an axial core subassembly mounted in the core slot and including:

an axial core tube formed of a non-explosive material;

a forward effector in or on the axial core tube; and an axial core high explosive disposed in the axial core tube and operative, when detonated, to drive the forward effector.

2. The warhead of claim 1 including a warhead body liner, wherein the preferentially fragmenting projectile rings are mounted on the warhead body liner.

3. The warhead of claim 2 including an adhesive bonding the preferentially fragmenting projectile rings to the warhead body liner, wherein the preferentially fragmenting projectile rings, the warhead body liner and the adhesive form a unitary composite fragmenting warhead body.

4. The warhead of claim 3 including an adhesive bonding the preferentially fragmenting projectile rings to one another.

5. The warhead of claim 2 wherein:

the warhead body liner defines a plurality of steps; and the preferentially fragmenting projectile rings are mounted in respective ones of the steps.

6. The warhead of claim 2 including an outer cover mounted over the preferentially fragmenting projectile rings.

7. The warhead of claim 2 wherein at least one of the preferentially fragmenting projectile rings includes an integral locator feature configured to rotationally align the preferentially fragmenting projectile ring with the warhead body liner.

8. The warhead of claim 2 wherein the warhead body liner includes an integral reinforcement rib.

9. The warhead of claim 2 wherein the preferentially fragmenting projectile rings are formed of metal and the warhead body liner is formed of a polymer.

10. The warhead of claim 1 wherein at least one of the preferentially fragmenting projectile rings includes fragment sections and an integral mounting feature that protrudes radially beyond the fragment sections.

11. The warhead of claim 1 wherein:

the warhead has a warhead longitudinal axis; and at least some of the preferentially fragmenting projectile rings are rotationally asymmetric about the warhead longitudinal axis.

12. The warhead of claim 1 further including at least one non-fragmenting projectile beam.

13. The warhead of claim 1 further including at least one integral mounting hardpoint member.

14. The warhead of claim 1 wherein at least one of the preferentially fragmenting projectile rings includes a non-reactive base ring and a reactive material mounted on the base ring.

15. The warhead of claim 14 wherein the non-reactive base ring defines voids therein, and the reactive material is mounted in the voids.

16. The warhead of claim 14 wherein the reactive material forms an outer ring component surrounding the non-reactive base ring.

17. The warhead of claim 1 wherein the warhead high explosive is tubular and radially surrounds the core slot.

18. The warhead of claim 17 wherein the preferentially fragmenting projectile rings radially surround the warhead high explosive.

19. The warhead of claim 1 wherein the outer warhead subassembly includes a tubular core slot wall defining the core slot and formed of a non-explosive material.

20. The warhead of claim 1 including a detonator configured to detonate the axial core high explosive, wherein the modular warhead is configured such that a detonation shock wave from the detonated axial core high explosive will detonate the warhead high explosive.

21. The warhead of claim 1 including a detonator configured to detonate the warhead high explosive, wherein the modular warhead is configured such that a detonation shock wave from the detonated warhead high explosive detonates the axial core high explosive.

22. The warhead of claim 1 wherein:

the warhead is configured to detonate the axial core high explosive;

the detonated axial core high explosive generates a detonation shock wave in the axial core tube to drive the forward effector; and the axial core tube shapes the detonation shock wave.

23. The warhead of claim 1 wherein the forward effector includes at least one of an explosively formed projectile, an anti-armor flyer, and a shaped charge jet.

24. The warhead of claim 1 including:

a detonation channel including a channel tube and a detonation channel explosive in the channel tube; and a detonator configured to detonate the detonation channel explosive;

wherein the modular warhead is configured such that a detonation wave from the detonated detonation channel explosive propagates through the channel tube to the axial core high explosive and detonates the axial core high explosive to drive the forward effector.

25. The warhead of claim 24 wherein:

the warhead has a warhead longitudinal axis; and the axial core subassembly is not aligned with the warhead longitudinal axis.

26. The warhead of claim 24 wherein the modular warhead is configured such that the detonation wave from the detonated detonation channel explosive also detonates the warhead high explosive after the detonation wave from the detonated detonation channel explosive detonates the axial core high explosive to drive the forward effector.

27. A munition comprising:

a munition platform; and a warhead on the munition platform for flight therewith, the warhead including:

a tubular warhead body including a plurality of serially arranged preferentially fragmenting projectile rings; and a warhead high explosive in the warhead body;

an outer warhead subassembly defining a core slot, the outer warhead subassembly including:

the warhead body; and the warhead high explosive; and an axial core subassembly mounted in the core slot and including:

an axial core tube formed of a non-explosive material;

a forward effector in or on the axial core tube; and an axial core high explosive disposed in the axial core tube and operative, when detonated, to drive the forward effector.

* * * * *